US011214451B2

(12) United States Patent
Ohishi et al.

(10) Patent No.: US 11,214,451 B2
(45) Date of Patent: Jan. 4, 2022

(54) SHEET CONTAINER, SHEET FEEDING INCORPORATING THE SHEET CONTAINER, AND IMAGE FORMING APPARATUS INCORPORATING THE SHEET CONTAINER

(71) Applicants: Shinya Ohishi, Kanagawa (JP); Ippei Kimura, Kanagawa (JP)

(72) Inventors: Shinya Ohishi, Kanagawa (JP); Ippei Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 16/716,708

(22) Filed: Dec. 17, 2019

(65) Prior Publication Data

US 2020/0216277 A1 Jul. 9, 2020

(30) Foreign Application Priority Data

Jan. 9, 2019 (JP) ..... JP2019-001621
Mar. 13, 2019 (JP) ..... JP2019-045478
Aug. 19, 2019 (JP) ..... JP2019-149985

(51) Int. Cl.
*B65H 1/20* (2006.01)

(52) U.S. Cl.
CPC ..... *B65H 1/20* (2013.01)

(58) Field of Classification Search
CPC ..... B65H 1/00; B65H 2405/00; B65H 2405/114; B65H 2405/113; B65H 2405/112; B65H 2405/1116; B65H 2511/10; B65H 2511/12; B65H 2701/1131; B65H 1/20; B65H 1/04
See application file for complete search history.

(56) References Cited

U.S. PATENT DOCUMENTS 5,328,167 A * 7/1994 Frank ..... B65H 1/04 271/147
8,944,429 B2 * 2/2015 Kataoka ..... B65H 3/0607 271/171
2012/0119434 A1 * 5/2012 Ueda ..... B65H 1/04 271/147

FOREIGN PATENT DOCUMENTS

JP 2016-074540 5/2016
JP 2018-002377 1/2018

* cited by examiner

*Primary Examiner* — Thomas A Morrison

(74) *Attorney, Agent, or Firm* — Harness, Dickey & Pierce, P.L.C.

(57) ABSTRACT

A sheet container includes a sheet loader, a pair of sheet regulators, a pressing member, and a pressing force adjusting device. The sheet loader is movable in a vertical direction and configured to load a sheet. The pair of sheet regulators is configured to regulate a position in a width direction of the sheet loaded on the sheet loader. The pressing member is disposed on at least one of the pair of sheet regulators and configured to press a lateral end face of the sheet, toward another one of the pair of sheet regulators in the width direction of the sheet. The pressing force adjusting device is configured to adjust pressing force generated by the pressing member to the sheet while maintaining a state in which the pressing member applies the pressing force to the sheet.

17 Claims, 20 Drawing Sheets

SHEET CONTAINER, SHEET FEEDING INCORPORATING THE SHEET CONTAINER, AND IMAGE FORMING APPARATUS INCORPORATING THE SHEET CONTAINER

CROSS-REFERENCE TO RELATED APPLICATIONS

This patent application is based on and claims priority pursuant to 35 U.S.C. § 119(a) to Japanese Patent Application Nos. 2019-001621, filed on Jan. 9, 2019, 2019-045478, filed on Mar. 13, 2019, and 2019-149985, filed on Aug. 19, 2019, in the Japan Patent Office, the entire disclosure of each of which is hereby incorporated by reference herein.

BACKGROUND

Technical Field

This disclosure relates to a sheet container, a sheet feeding device incorporating the sheet container, and an image forming apparatus incorporating the sheet container.

Discussion of the Background Art

Various types of sheet containers are known to include a sheet loader that is lifted and lowered, a pair of sheet regulating members that regulates a position in a width direction of a sheet or sheets loaded on the sheet loader, and a pressing member that is disposed on at least a sheet regulating member of the pair of sheet regulating members to press an end face in the width direction of the sheet toward the other sheet regulating member.

SUMMARY

At least one aspect of this disclosure provides a sheet container including a sheet loader, a pair of sheet regulators, a pressing member, and a pressing force adjusting device. The sheet loader is movable in a vertical direction and configured to load a sheet. The pair of sheet regulators is configured to regulate a position in a width direction of the sheet loaded on the sheet loader. The pressing member is disposed on at least one of the pair of sheet regulators and configured to press a lateral end face of the sheet, toward another one of the pair of sheet regulators in the width direction of the sheet. The pressing force adjusting device is configured to adjust pressing force generated by the pressing member to the sheet while maintaining a state in which the pressing member applies the pressing force to the sheet.

Further, at least one aspect of this disclosure provides a sheet feeding device including the above-described sheet container, and a sheet feeding unit. The sheet container is configured to contain the sheet. The sheet feeding unit is configured to feed the sheet contained in the sheet container.

Further, at least one aspect of this disclosure provides an image forming apparatus including the above-described sheet container, and an image forming device. The sheet container is configured to contain the sheet. The image forming device is configured to form an image on the sheet fed by the sheet container.

BRIEF DESCRIPTION OF THE SEVERAL VIEWS OF THE DRAWINGS

An exemplary embodiment of this disclosure will be described in detail based on the following figured, wherein.

Figure 1:
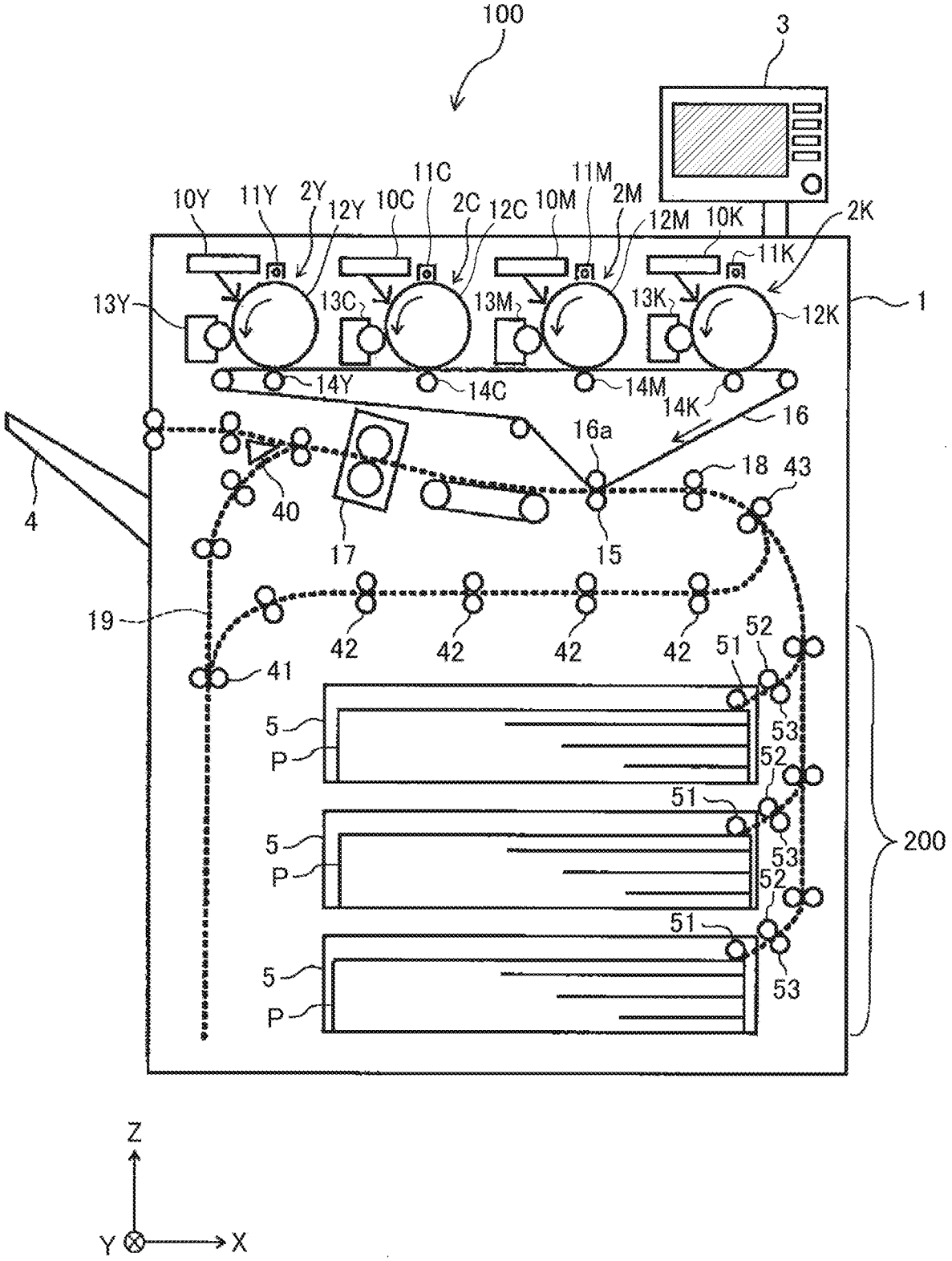
FIG. 1 is a diagram illustrating a schematic configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet container, a sheet feeding device, and an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet container, sheet feeding device, and image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an electrophotographic image forming apparatus (hereinafter simply referred to as an image forming apparatus) which forms an image by an electrophotographic system is described as an image forming apparatus including a sheet container and a sheet feeding device according to this disclosure. In the following embodiments, a color laser printer is described as an example of the image forming apparatus. However, the image forming apparatus is not limited to a color printer but may be a monochrome printer. The image forming apparatus is not limited to the printer and may be another image forming apparatus such as a copier and a multifunction peripheral. The image forming apparatus including the sheet container and the sheet feeding device according to the present embodiment is not limited to the image forming apparatus of the electrophotographic system, and may be an image forming apparatus of another system such as an ink jet system.

FIG. 1 is a diagram illustrating a schematic configuration of an image forming apparatus 100 according to an embodiment of this disclosure.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

The image forming apparatus 100 includes an intermediate transfer belt 16 and image forming units 2Y, 2C, 2M, and 2K. The intermediate transfer belt 16 is disposed substantially at a center of a housing 1 of the image forming apparatus 100. The four image forming units 2Y, 2C, 2M, and 2K are disposed side by side (aligned) above the intermediate transfer belt 16. The four image forming units 2Y, 2C, 2M, and 2K perform image formation with toners of respective colors of yellow (Y), cyan (C), magenta (M), and black (K). Since the four image forming units 2Y, 2C, 2M, and 2K have configurations substantially identical to each other in configuration and operation, the image forming units 2Y, 2C, 2M, and 2K are occasionally referred to in a singular form as the "image forming unit 2" without respective suffixes indicating the respective colors of toners.

The image forming unit 2 (i.e., the image forming units 2Y 2C, 2M, and 2K) includes a laser scanning unit 10 (i.e., laser scanning units 110Y, IOC, 10M, and 10K), a charging unit 11 (i.e., charging units 11Y, 11C, 11M, and 11K), a photoconductor 12 (i.e., photoconductors 12Y, 12C, 12M, and 12K), a developing unit 13 (i.e., developing units 13Y, 13C, 13M, and 13K), and primary transfer roller 14 (i.e., primary transfer rollers 14Y, 14C, 14M, and 14K). The photoconductor 12 is a latent image bearer opposed to a tension surface on an upper portion of the intermediate transfer belt 16. The charging unit 11 is a charger. The laser scanning unit 10 is a latent image forming unit. The charging unit 11, the laser scanning unit 10, and the developing unit 13 are disposed around the photoconductor 12. The primary transfer roller 14 is disposed facing (opposed to) the photoconductor 12 across the intermediate transfer belt 16 to form a primary transfer nip region. In other words, the intermediate transfer belt 16 is interposed between the photoconductor 12 and the primary transfer roller 14, where the primary transfer nip region is formed.

A secondary transfer roller 15 is provided below the intermediate transfer belt 16. A secondary transfer counter roller 16*a* is disposed facing the secondary transfer roller 15 across the intermediate transfer belt 16. The secondary transfer roller 15 and the secondary transfer counter roller 16*a* form a secondary transfer nip region.

A sheet feeding device 200 including sheet feed trays 5 is disposed in a lower part of the housing 1 of the image forming apparatus 100. The sheet feed trays 5 includes three sheet feed trays (that function as first, second, and third sheet containers) arranged in a vertical direction. Each of the sheet feed trays 5 is removably installed to (in other words, detachably attached to) a device housing of the sheet feeding device 200. Each of the sheet feed trays 5 contains a sheet P or sheets P including a material made of a transfer sheet or a resin film.

As the image forming apparatus 100 starts a printing operation, the photoconductor 12 is rotationally driven in a counterclockwise direction in FIG. 1, and the intermediate transfer belt 16 is rotationally driven in a clockwise direction in FIG. 1. At this time, the charging unit 11 uniformly charges a surface of the photoconductor 12 to a predetermined polarity. The, the laser scanning unit 10 of each color emits laser light based on image data to the uniformly charged surface of the photoconductor 12, so that an electrostatic latent image is formed on the surface of the photoconductor 12. The developing unit 13 develops the electrostatic latent image formed on the surface of the photoconductor 12 to a visible toner image. The toner image is transferred to the intermediate transfer belt 16 by the primary transfer roller 14 in the primary transfer nip region. Transfer residual toner remaining on the surface of the photoconductor 12 after the primary transfer of the toner image is removed by a photoconductor cleaning device.

When forming a color image, the above-described image forming operation is performed in all the image forming units 2, that is, in the four image forming units 2Y, 2C, 2M, and 2K, so that a yellow toner image, a cyan toner image, a magenta toner image, and a black toner image formed on respective photoconductors 12Y, 12C, 12M, and 12K are sequentially transferred to the intermediate transfer belt 16 in a superimposed manner.

The sheet P is fed from the sheet feeding device 200. A user selects one of the three sheet feed trays 5 via an input terminal such as a control panel 3 or an external personal computer, so as to feed the sheet P contained in the selected sheet feed tray 5.

A sheet conveyance passage 19 is indicated by a broken line in FIG. 1. The sheet P travels along the sheet conveyance passage 19 in the image forming apparatus 100.

The sheet P that is fed from the selected sheet feed tray 5 is conveyed toward a pair of registration rollers 18 and a leading end of the sheet P contacts to stop at the pair of registration rollers 18.

After the sheet P has contacted and aligned by the pair of registration rollers 18, the pair of registration rollers 18 conveys the sheet P toward the secondary transfer nip region at a timing synchronized with a timing of conveyance of the toner image formed on the intermediate transfer belt 16. The transfer residual toner remaining on and adhering to a surface of the intermediate transfer belt 16 after the secondary transfer of the toner image at the secondary transfer nip region is removed by an intermediate transfer belt cleaning device.

The sheet P onto which an unfixed toner image is transferred at the secondary transfer nip region is then conveyed to a fixing device 17. In the fixing device 17, the unfixed toner image is fixed to the sheet P, then ejected to a sheet ejection tray 4 in a case of single-side printing.

In a case of duplex printing, a separator 40 switches and changes an orientation of the sheet P, so that the sheet P having an image on a first face is conveyed to a duplex printing passage. The sheet P conveyed to a pair of reverse rollers 41 by the separator 40 is then conveyed to a pair of duplex printing rollers 42 by forward rotations and reverse rotations of the pair of reverse rollers 41. At this time, both the front and back sides of the sheet P with respect to a sheet conveyance direction are reversed from the state in which the image is formed on the front face of the sheet P. After the sheet P is conveyed to a pair of relay rollers 43 and the pair of registration rollers 18, an image is also formed on a second face by a process similar to the above-described image formation process, and the sheet P having the images on both sides (i.e., the first face and the second face) of the sheet P is ejected to a sheet ejection tray 4.

Optionally, different from the above-described image formation process, a user may connect a sheet feeding hank capable of feeding a large number of sheets P, to the housing 1 of the image forming apparatus 100, or connect a finisher in which a stapling process and a folding process are formed, to the housing 1 of the image forming apparatus 100, instead of the sheet ejection tray 4.

Now, a description is given of a configuration and functions of the sheet feeding device 200.

As illustrated in FIG. 1, each of the three sheet feed trays 5 of the sheet feeding device 200 includes a sheet feeding unit including a sheet feed roller 51, a sheet separation and conveyance roller 52, and a reverse roller 53. The sheet feeding unit feeds the sheet P contained in the sheet feed tray 5. Specifically, the sheet P conveyed by the sheet feed roller 51 is conveyed into a separation nip region that is a contact position where the sheet separation and conveyance roller 52 and the reverse roller 53 contact. The sheet separation and conveyance roller 52 rotationally drives in the counterclockwise direction in FIG. 1 as a drive motor transmits a conveyance force toward a downstream side in a sheet conveyance direction to the sheet P.

The reverse roller 53 contacts (abuts against) the sheet separation and conveyance roller 52. The reverse roller 53 receives the conveyance force from a drive motor so as to rotationally drive the reverse roller 53 in the counterclockwise direction in FIG. 1.

In such a configuration, a surface moving direction of the sheet separation and conveyance roller 52 and a surface moving direction of the reverse roller 53 at the separation nip region are opposed to each other, so that an uppermost sheet P placed on top of a sheet bundle P is separated from the subsequent sheets P and the uppermost sheet alone is conveyed.

Specifically, in the separation nip region, a surface of the sheet separation and conveyance roller 52 moves in the sheet conveyance direction. On the other hand, a surface of the reverse roller 53 tends to move in a direction opposite to the sheet conveyance direction. In order to address this inconvenience, a drive transmitting portion of the reverse roller 53 includes a torque limiter. Therefore, in a case in which a force of the surface of the reverse roller 53 in the sheet conveyance direction is greater than upper limit torque of the torque limiter, the reverse roller 53 rotates in the clockwise direction in FIG. 1 so that the surface of the reverse roller 53 moves in the sheet conveyance direction.

The reverse roller 53 contacts the sheet separation and conveyance roller 52 with a predetermined pressure. The reverse roller 53 is rotated together with rotation of the sheet separation and conveyance roller 52 or movement of the sheet P in a state in which the reverse roller 53 is in directly contact with the sheet separation and conveyance roller 52 or in a state in which the reverse roller 53 contacts the sheet separation and conveyance roller 52 via a single sheet P (in other words, in a state in which only one sheet P is interposed between the reverse roller 53 and the sheet separation and conveyance roller 52 in the separation nip region). That is, the reverse roller 53 rotates in the clockwise direction in FIG. 1, which corresponds to the sheet conveyance direction.

By contrast, the torque limiter is set so that, in a case in which two or more sheets P enter the separation nip region, a rotation force of the reverse roller 53, which is rotated together with rotation of the sheet separation and conveyance roller 52 or movement of the sheet P, is smaller than the upper limit torque of the torque limiter. Therefore, the reverse roller 53 rotationally drives in the counterclockwise direction in FIG. 1, which is the direction opposite to a rotation direction of the reverse roller 53. The reverse roller 53 rotationally drives in the direction opposite to the rotation direction, so that the reverse roller 53 applies a moving force in the direction opposite to the sheet conveyance direction to the subsequent sheets P, in other words, the sheet P of the sheet bundle P other than the uppermost sheet P, which are conveyed toward the separation nip region. As a result, the subsequent sheets P are pushed back, and the uppermost sheet P alone is separated from the sheet bundle, and therefore multiple feeding is prevented.

The uppermost sheet P separated due to an action of the sheet separation and conveyance roller 52 and the reverse roller 53 is conveyed toward the pair of registration rollers 18.

As a sheet separation mechanism for preventing multiple feeding, there is a configuration of using a separation pad that prevents second and subsequent sheets P from moving in the sheet conveyance direction instead of the reverse roller 53 that applies the moving force in the direction opposite to the sheet conveyance direction to the second and subsequent sheets P. In the configuration in which the separation pad is employed, the lowermost sheet P alone may be prevented from moving in the sheet conveyance direction. Therefore, when three or more sheets P reach the separation nip region, there may be a case in which multiple feeding is not be prevented.

By contrast, the configuration according to the present embodiment employs the reverse roller 53. With this configuration, when three or more sheets P reach the separation nip region, the excessive sheets P are sequentially returned from the lowermost sheet P to an upstream side in the sheet conveyance direction. As a result, the subsequent sheets P other than the uppermost sheet P is moved to the side upstream from the sheet separation nip region in the sheet conveyance direction. Therefore, multiple feeding is prevented more reliably.

Figure 2:
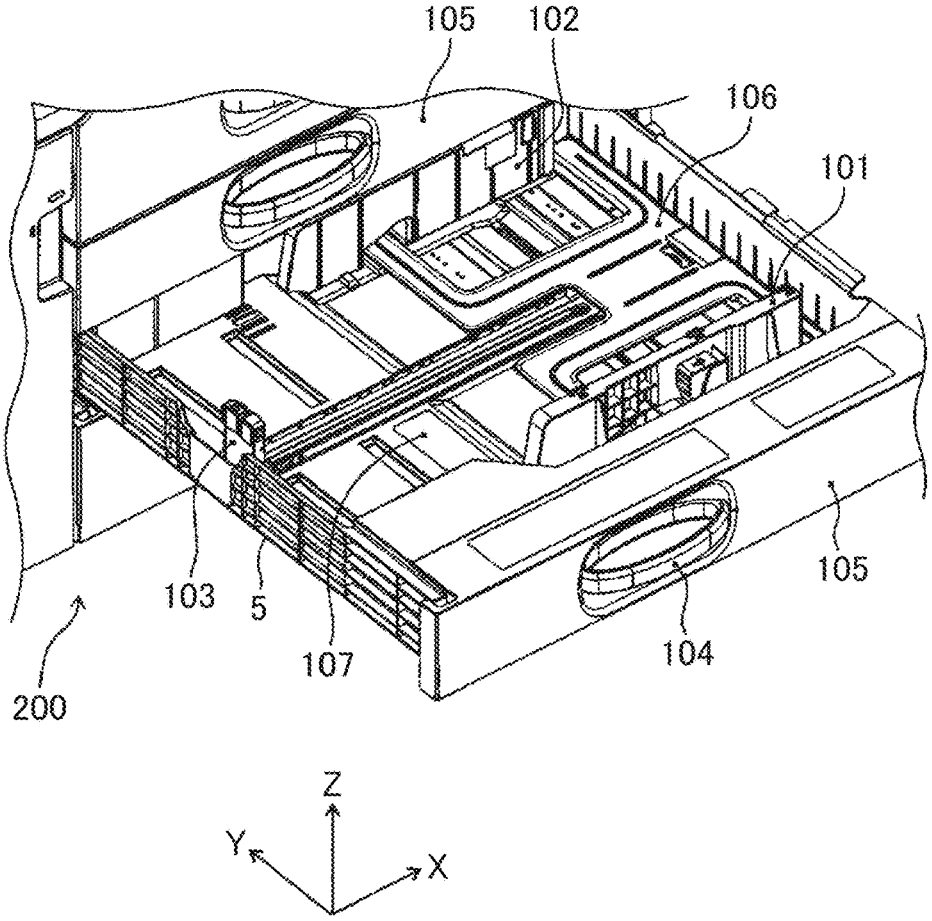
FIG. 2 is a perspective view illustrating a sheet feeding device in a state in which one of sheet feed trays provided in the image forming apparatus of FIG. 1 is pulled out toward a front side of the image forming apparatus.

FIG. 2 is a perspective view illustrating the sheet feeding device 200 in a state in which one of the sheet feed trays 5 provided in the image forming apparatus 100 of FIG. 1 is pulled out toward a front side of the image forming apparatus TOO.

Hereinafter, the sheet feed trays 5 are occasionally referred to in a singular form as the "sheet feed tray 5" when explaining the configuration and functions identical to each other in the sheet feed trays 5.

The sheet feed tray 5 that functions as a sheet container includes a near side fence 101, a far side fence 102, and an end fence 103. The near side fence 101 is a sheet alignment fence disposed on the front side in a tray removing direction of each of the sheet feed trays 5 and the far side fence 102 is a sheet alignment fence disposed on the rear side in the tray removing direction of the sheet feed tray 5. The near side fence 101 and the far side fence 102 correspond to a pair of side fences that function as sheet regulators or a pair of sheet regulators to regulate positions of side ends in a width direction (i.e., a Y direction) orthogonal to the sheet conveyance direction (i.e., an X direction) of the sheet P. The end fence 103 regulates a position of the trailing end of the sheet P in the sheet conveyance direction (i.e., the X direction).

A pressing member 110 is provided on an upper side face on the downstream side in the sheet conveyance direction (i.e., a +X direction) of the far side fence 102 that is one of the (pair of) sheet regulators. The pressing member 110 presses a lateral end face of the sheet P on a downstream side in the sheet conveyance direction, toward the near side fence 101 in the sheet width direction.

The two side fences, which are the near side fence 101 and the far side fence 102, are slidable together with each other in the width direction (i.e., the Y direction). Specifically, the near side fence 101 and the far side fence 102 move in the opposite directions from each other by the same distance in synchronization with movements of the far side fence 102 and the near side fence 101 with respect to a predetermined sheet width direction reference position set at the substantially center in the width direction. Therefore, after loading the sheet bundle on a movable bottom plate 106, the near side fence 101 and the far side fence 102 are moved, so that the near side fence 101 and the far side fence 102 are brought into contact with both ends of the sheet bundle in the width direction of the sheet bundle. Accordingly, the lateral center position of the sheet P of any side in the width direction, in other words, the central position of the sheet P having any size in the width direction, is positioned to the predetermined sheet width direction reference position.

The end fence 103 is attached to each of the sheet feed trays 5 so as to be slidable in the sheet conveyance direction (i.e., the X direction) in order to cope with various sheet sizes. When loading the sheet bundle on the sheet feed tray 5, the end fence 103 is slid to be retracted toward an upstream side in the sheet conveyance direction (i.e., a −X direction) After the sheet bundle is loaded on the movable bottom plate 106, the end fence 103 is slid toward the trailing end of the sheet bundle so that the end fence 103 contacts the trailing end of the sheet bundle. As a result, the sheets P in the sheet bundle contained in the sheet feed tray 5 is positioned in the sheet conveyance direction.

The sheet feed tray 5 includes a fixed bottom plate 107 and the movable bottom plate 106. The fixed bottom plate 107 forms a bottom surface of the sheet feed tray 5 and supports the trailing end side of the sheet P. The movable bottom plate 106 functions as a sheet loader movable in a vertical direction. The movable bottom plate 106 has a downstream side in the sheet conveyance direction (i.e., a +X direction) that is lifted and lowered to support the leading end side of the sheet P.

Figure 3:
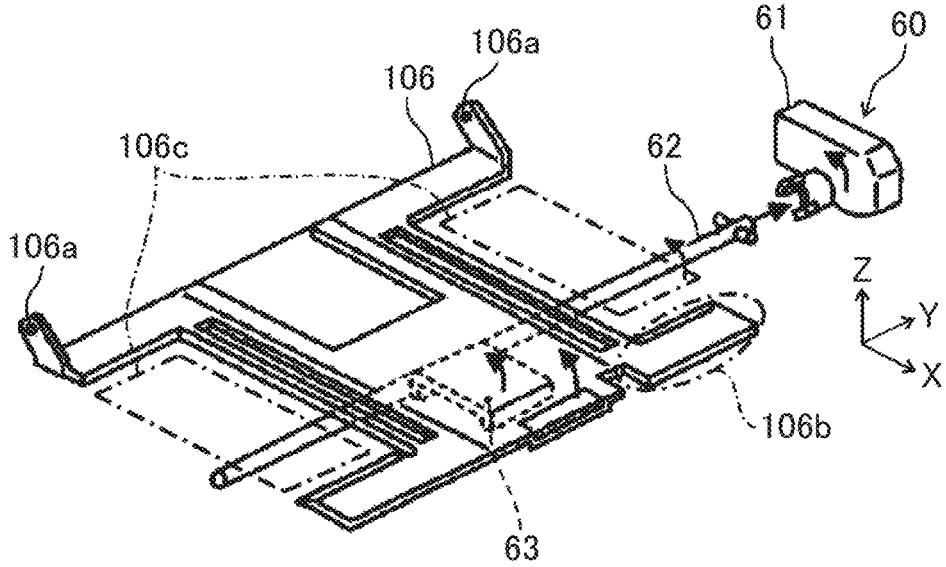
FIG. 3 is a perspective view illustrating a schematic configuration of a drive mechanism that lifts and lowers a movable bottom plate of the sheet feed tray of FIG. 2.
Figure 4:
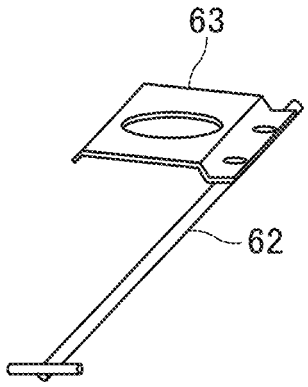
FIG. 4 is a perspective view illustrating a drive shaft and a rotary arm of the drive mechanism.

FIG. 3 is a perspective view illustrating a schematic configuration of a drive mechanism 60 that lifts and lowers the movable bottom plate 106 of the sheet feed tray 5 of FIG. 2. FIG. 4 is a perspective view illustrating a drive shaft 62 and a rotary arm 63 of the drive mechanism 60.

As illustrated in FIG. 3, the movable bottom plate 106 includes a support hole 106*a* on both ends in the width direction (i.e., the Y direction), on the upstream side in the sheet conveyance direction (i.e., a −X direction) of the movable bottom plate 106. The support hole 106*a* is rotatably supported by a rotating shaft mounted on side walls of the sheet feed tray 5. Specifically, the movable bottom plate 106 is rotatably supported by a rotating shaft provided on a back side wall of the sheet feed tray 5 and a rotating shaft provided on a front side wall.

The drive mechanism 60 that lifts and lowers the movable bottom plate 106 includes a motor 61, the drive shaft 62, and the rotary arm 63. The motor 61 is provided in the housing 1. The drive shaft 62 is coupled to the motor 61. The rotary arm 63 is integrally attached to an end of the drive shaft 62 and is mounted on the bottom of the movable bottom plate 106.

As the sheet feed tray 5 is set in the housing 1, the motor 61 is driven, the drive shaft 62 rotates along with rotation of the motor 61, and the rotary arm 63 that integrally rotates together with the drive shaft 62 rotates the movable bottom plate 106 to lift the downstream side of the movable bottom plate 106 in the sheet conveyance direction. As a result, the sheet P that is loaded on the movable bottom plate 106 is held (stands by) in a sheet feed position. The movable bottom plate 106 has space 106*c* for the near side fences 101 and the far side fence 102 to move. The movable bottom plate 106 further includes a flat portion 106*b* disposed downstream from the space 106*c* in the sheet conveyance direction (i.e., the +X direction). The flat portion 106*b* has a width exceeding the maximum sheet size so as not to bend the leading end of the sheet or generate a paper jam due to hanging down of the end of the sheet P fed from the sheet feed tray 5.

In the sheet feed tray 5, the position of the sheet P loaded on the fixed bottom plate 107 and the movable bottom plate 106 is regulated by the near side fence 101, the far side fence 102, and the end fence 103, Then, the sheet bundle regulated by the near side fence 101, the far side fence 102, and the end fence 103 is lifted by the movable bottom plate 106 to a position where the sheet feed roller 51 (refer to FIG. 1) is located. Then, each uppermost sheet P placed on top of the sheet bundle is fed one by one from the sheet bundle.

Figure 5:
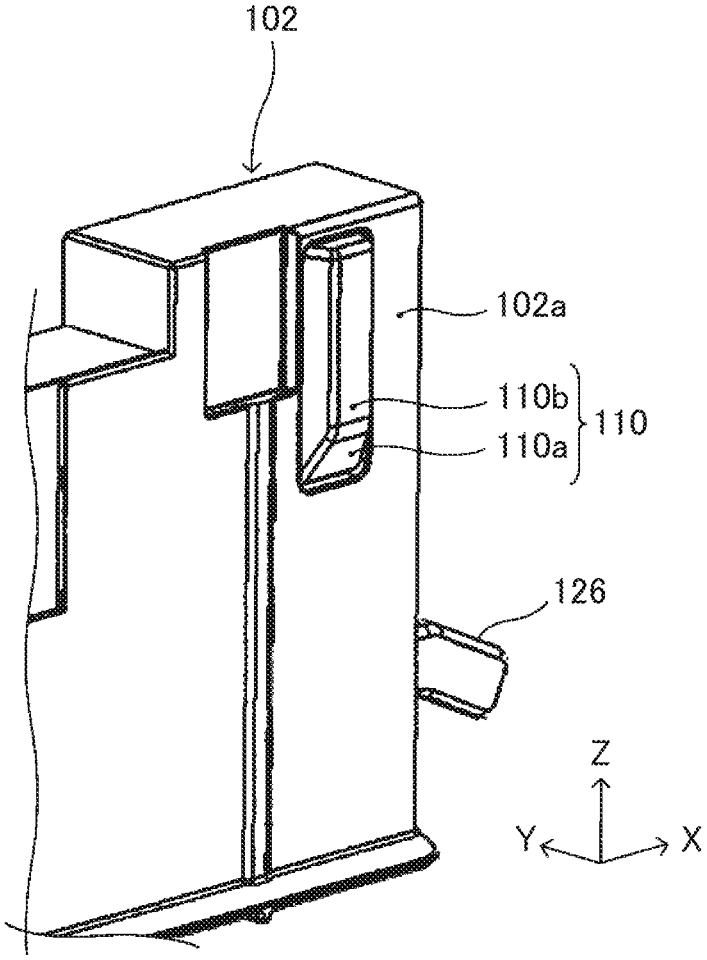
FIG. 5 is a perspective view illustrating a downstream side in a sheet conveyance direction of a far side fence.

FIG. 5 is a perspective view illustrating the far side fence 102 on the downstream side in the sheet conveyance direction.

As illustrated in FIG. 5, the pressing member 110 provided on the far side fence 102 is biased toward the sheet bundle side by a biasing member. A part of the pressing member 441 protrudes from a regulating surface that regulates the end in the width direction (i.e., the Y direction) of the sheet bundle of the far side fence 102.

The pressing member 110 includes an inclined face 110*a* and a pressing face 110*b*. The pressing face lib is disposed parallel in a vertical direction of the far side fence 102. The inclined face 110*a* is connected to a lower end of the pressing face 110*b*. The inclined face 110*a* is an inclined surface to incline toward the far side fence 102 in a downward direction (i.e., a −Z direction).

The pressing member 110 is arranged such that a part of the pressing face 110*b* is higher (i.e., a +Z direction) than the height of the uppermost sheet P of the sheet bundle measured when the sheets P are fully loaded on the sheet feed tray 5, in other words, when the maximum number of sheets P are accommodated in the sheet feed tray 5. A storage 102*a* is provided on the downstream side in the sheet conveyance direction (i.e., the +X direction) of the far side fence 102. The storage 102*a* contains a pressing force adjustment mechanism 120 that functions as a pressing force adjusting device (see FIGS. 7A and 7B). The pressing force adjustment mechanism 120 adjusts pressing force generated by the pressing member 110 to the sheet P.

As described above, the pair of side fences, which are the near side fence 101 and the far side fence 102 are attached to the sheet teed tray 5 so as to be slidable in the width direction (i.e., Y direction) in order to cope with various sheet sizes. The pair of side fences (i.e., the near side fence 101 and the far side fence 102) is manually slid in the width direction (i.e., the Y direction), and the pair of side fences the near side fence 101 and the far side fence 102) are brought into contact with both the ends in the width direction of the sheet bundle. In this manner, the near side fence 101 and the far side fence 102 are manually slid, so that, depending on the user, there is a case in which the movement of the near side fence 101 and the far side fence 102 stops before the near side fence 101 and the far side fence 102 are brought into contact with the ends of the sheet bundle in the width direction, thereby generating a gap between the near side fence 101 and the far side fence 102 and the sheet bundle.

The near side fence 101 and the far side fence 102 slide in the width direction (i.e., the Y direction), and play inevitably occurs in the width direction (i.e., the Y direction). As a result, even if each of the near side fence 101 and the far side fence 102 is moved until the near side fence 101 and the far side fence 102 come into contact with the end in the width direction of the sheet bundle, it is likely that the gap is generated between the near side fence 101 and the sheet bundle due to the play.

Since the gap occurs between the side fence and the sheet bundle, the position in the width direction (i.e., the Y direction) of the sheet bundle on the movable bottom plate 106 is not regulated. As a result, the position in the width direction (i.e., the Y direction) is likely to be different in each sheet P to be fed, and the position in the width direction of the image formed on the sheet P is likely to be different in each sheet P, or the sheet P is conveyed in a skewed state and the image is likely to be formed obliquely with respect to the sheet P.

In the present embodiment, the pressing member 110 that partially protrudes from the far side fence 102 is provided on the far side fence 102 out of the pair of side fences (i.e., the near side fence 101 and the far side fence 102). As a result, even if the gap occurs between the pair of side fences (i.e. the near side fence 101 and the far side fence 102) and the sheet bundle due to structural play, the pressing face 110*b* of the pressing member 110 that protrudes from the far side fence 102 elastically contacts one end in the width direction on the leading end side of the upper portion of the sheet bundle. As a result, the upper sheet of the sheet bundle is pressed by the pressing face 110*b* of the pressing member 110 toward the near side fence 101, and the upper sheet moves to the front side (i.e., a −Y direction) to come into contact with the near side fence 101. As a result, the position in the width direction (i.e., the Y direction) of the sheet on the upper portion of the sheet bundle is regulated by the pressing face 110*b* of the pressing member 110 and the near side fence 101. As a result, the position of the sheet P in the width direction (i.e., the Y direction) and the orientation of the sheet P to be fed are aligned, and variation in image forming positions with respect to the sheet is restrained or prevented.

In the present embodiment, a lower end of the pressing member 110 does not protrude from the regulating face opposed to the sheet bundle of the far side fence 102, and includes an inclined face 110*a* so as to be located toward the far side fence 102 in the downward direction (i.e., the −Z direction) from the lower end of the pressing face 110*b*. As described above, since the lower end of the pressing member 110 enters the far side fence 102, the sheet P of the sheet bundle is prevented from being hung on the lower end of the pressing member 110 when the sheet bundle is lifted together with elevation of the movable bottom plate 106.

When the sheet bundle is lifted together with the movable bottom plate 106, one end of the sheet bundle in the width direction comes into contact with the inclined face 110*a* of the pressing member 110. The sheet P that is brought into contact with the inclined face 110*a* is guided by the inclined face 110*a* to move toward the near side fence 101 as the movable bottom plate 106 is lifted up. Consequently, the other end of the sheet bundle in the width direction is brought into contact with the near side fence 101. As a result, the position of the sheet in the width direction (i.e., the Y direction) on the upper portion of the sheet bundle is regulated by the pressing face 110*b* of the pressing member 110 and the near side fence 101.

In the present embodiment, since the sheet loaded on the movable bottom plate 106 is inclined by the pressing member 110 toward the near side fence 101, the center position of the sheet P in the width direction is displaced from the predetermined sheet width direction reference position. Therefore, the position in the width direction of the image formed on the sheet is displaced from a target position.

Therefore, it is preferable to perform control for adjusting the position of the image when the sheet bundle is set on the sheet feed tray 5. Specifically, when the sheet bundle is set on the sheet feed tray 5, a predetermined test pattern is formed on the sheet P, a distance between the end of the sheet in the width direction and the test pattern is measured, and a difference between a target distance and the measured distance is calculated. The sheet P on which the test pattern output from the image forming apparatus 100 is formed is set and read in a scanner. Then, the distance between the end of the sheet in the width direction and the test pattern is measured based on image data read by the scanner. Alternatively, a detector such as a charge-coupled device (CCD) camera may be disposed on the sheet conveyance passage of the sheet P (i.e., a sheet conveyance passage on the downstream side in the sheet conveyance direction of the secondary transfer nip region), the end in the sheet width direction and the test pattern is detected by the detector, and the distance is measured based on the detection result.

The image forming position in the sheet width direction is corrected based on a difference value between the target distance and the measured distance. Specifically, a laser beam irradiation start timing of the laser scanning unit 10 is changed based on the difference value between the target distance and the measured distance, so as to correct the image forming position in the width direction. In this manner, the image forming position in the width direction is corrected based on the difference value between the target distance and the measured distance, so as to form the image at the target position of the sheet Pin the width direction.

As described above, the sheet bundle loaded on the movable bottom plate 106 is regulated in a predetermined position in the width direction by the pressing member 110 and the near side fence 101. Therefore, when the sheet bundle is set on the sheet feed tray 5, after the image position is adjusted, the image is formed at the target position in the width direction of the sheet P.

However, as the number of sheets of the sheet bundle remaining on the movable bottom plate 106 decreases, stiffness of the sheet bundle becomes low, and the sheet bundle is likely to be buckled by the pressing force by the pressing member 110 in particular, when the sheets P of the sheet bundle are sheets having small rigidity such as thin papers, such buckling of the sheet bundle is likely to occur. If the sheet P is fed in such a buckled state, the sheet P is wrinkled or the sheet feeding position is displaced, so that the image position on which an image is formed on the sheet P is likely to vary for each sheet P.

Therefore, in comparative image forming apparatuses, when the number of sheets P of the sheet bundle loaded on the movable bottom plate 106 was equal to or smaller than a predetermined number of sheets, the pressing member 110 was retracted into the far side fence 102 as the movable bottom plate 106 was lifted, and the pressing force to the sheet P was released by the pressing member 110.

However, if the pressing member 110 is retracted into the far side fence 102 to release the pressing force to the sheet P by the pressing member 110, a gap is generated between the pressing member 110 and the sheet bundle, and the width direction position of the sheet P is not regulated. As a result, it is likely that the sheet P on the movable bottom plate 106 moves in the width direction or skew due to vibration. As a result, when the number of remaining sheets P loaded on the movable bottom plate 106 become small, it was likely that the image position formed on the sheet P varied for each sheet.

Therefore, in the present embodiment, the pressing force adjustment mechanism 120 that adjusts the pressing force of the pressing member 110 to the sheet P is provided so that the pressing force to the sheet P by the pressing member 110 is not released. In other words, the pressing force adjustment mechanism 120 adjusts the pressing force generated by the pressing member 110 to the sheet P while maintaining a state in which the pressing member 110 applies the pressing force to the sheet P.

A detailed description is given of the pressing force adjustment mechanism 120 according to the present embodiment of this disclosure.

Figure 6:
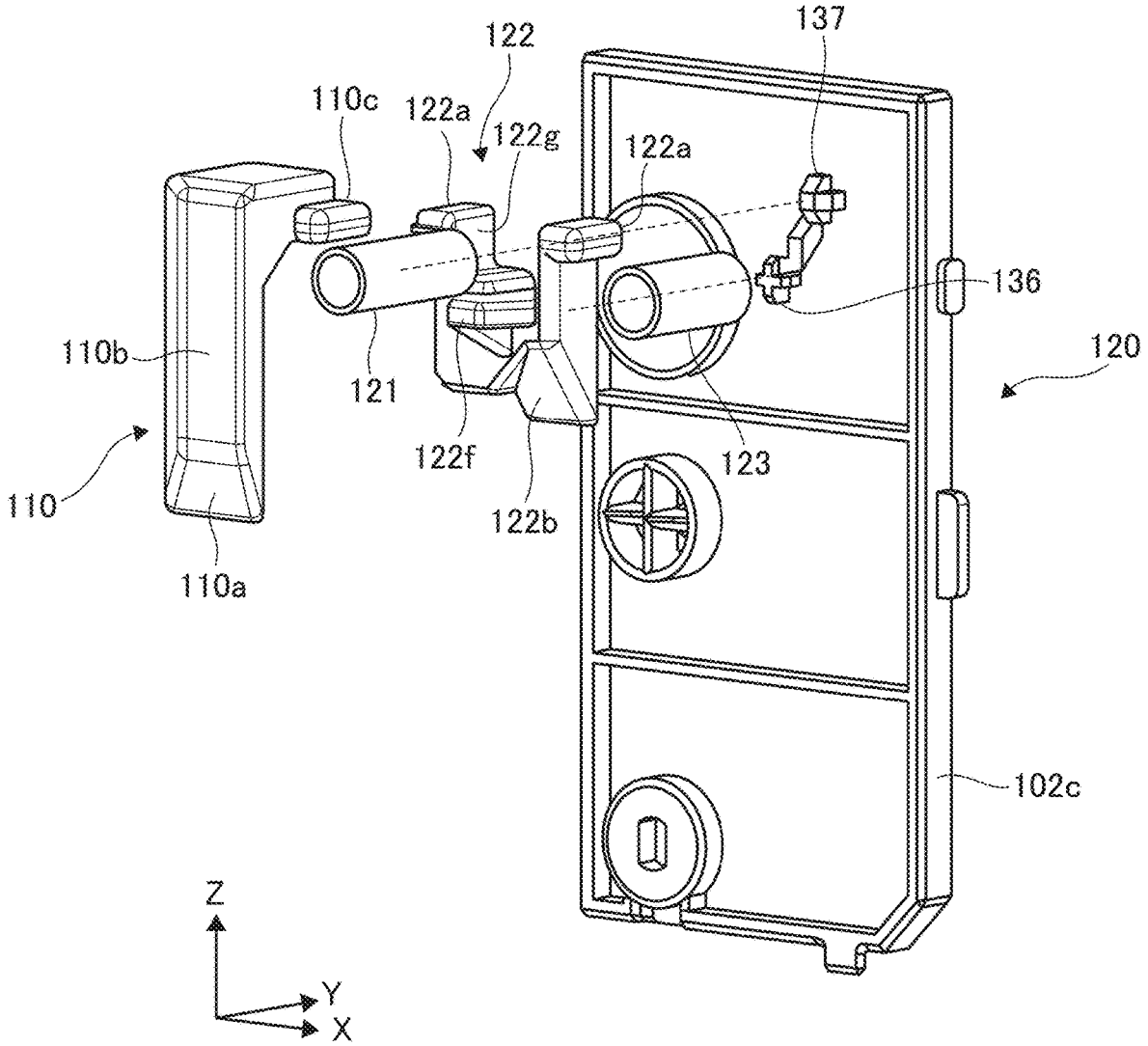
FIG. 6 is a perspective view illustrating a configuration of a pressing force adjustment mechanism of a first embodiment stored in a storing portion of the far side fence.

FIG. 6 is a perspective view illustrating a configuration of the pressing force adjustment mechanism 120 of a first example of the present embodiment, stored in the storage 102*a* of the far side fence 102.

Figure 7A:
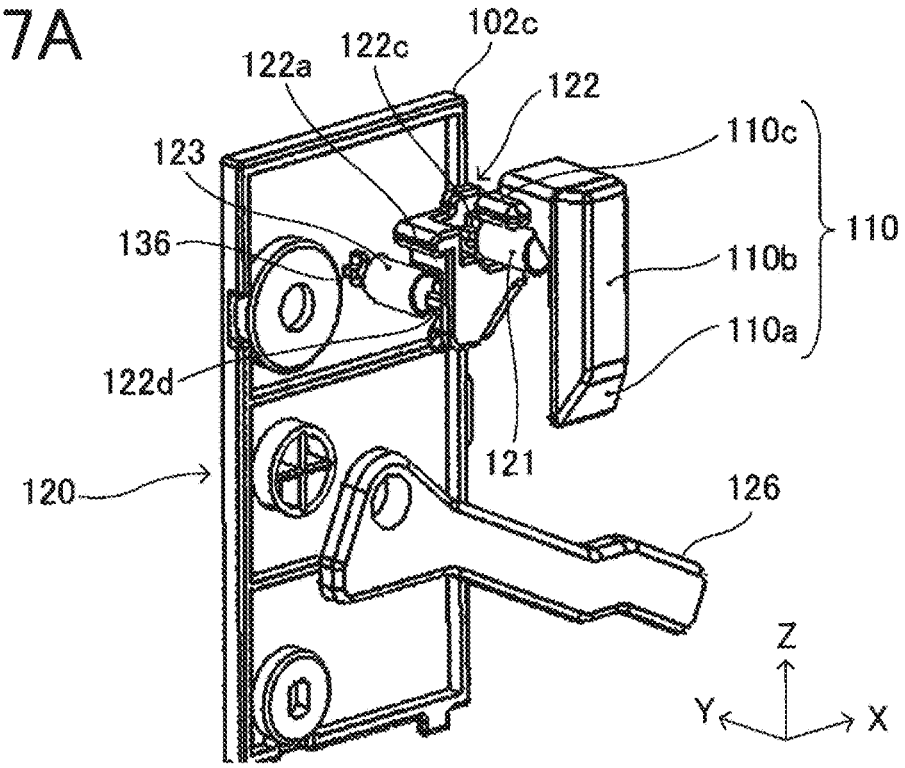
FIGS. 7A and 7B are perspective views illustrating a configuration of a pressing force adjustment mechanism of a second embodiment stored in a storing portion of the far side fence.
Figure 7B:
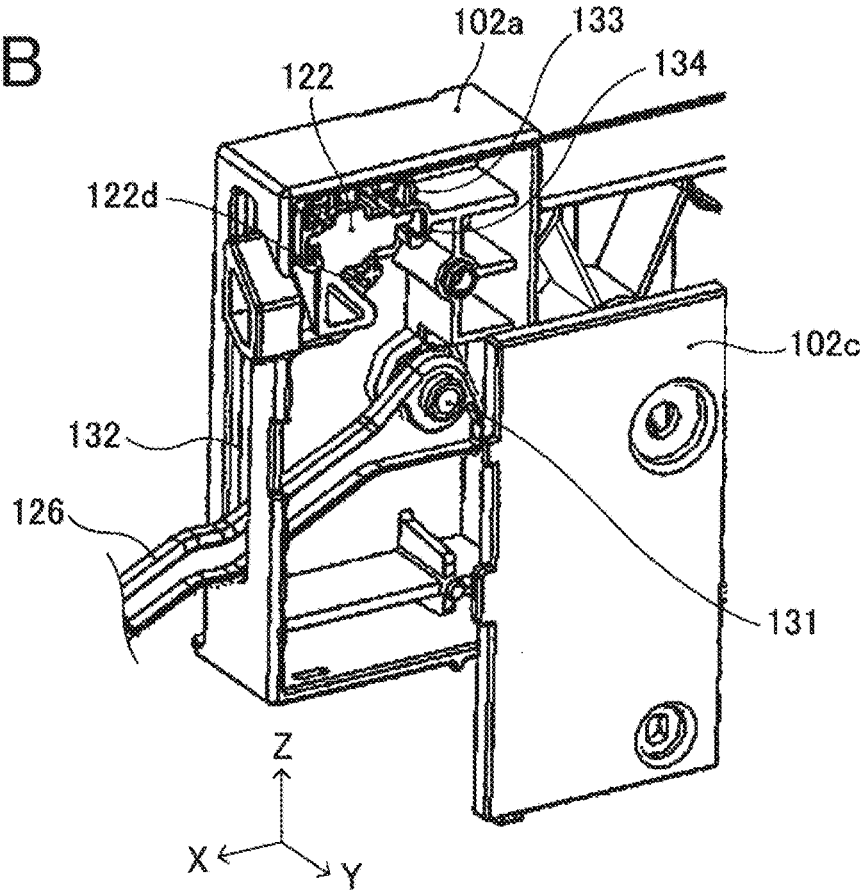

FIGS. 7A and 7B are perspective views illustrating a configuration of the pressing force adjustment mechanism 120 of a second example of the present embodiment, stored in the storage 102*a* of the far side fence 102. Specifically, FIG. 7A is a perspective view illustrating a storage cover 102*c* of the storage 102*a* and components of the pressing force adjustment mechanism 120 of the second example. FIG. 7B is a perspective view illustrating a main part of the far side fence 102 in a state in which the storage cover 102*c* is detached.

In the first example, an adjustment member 122 that adjusts the pressing force of the pressing member 110 comes into contact with and separates from the pressing member 110, thereby switching the pressing force of the pressing member 110 to adjust the pressing force. In the second example, a biasing force of a first pressure spring 121 is changed to adjust the pressing force by the pressing member 110.

Therefore, in the first example, the adjustment member 122 includes a contact protrusion 122*f* that contacts the pressing member 110 and a spring relief 122*g* having a notch shape. The spring relief 122*g* releases the first pressure spring 121. By contrast, in the second example, the adjustment member 122 does not include the contact protrusion 122*f* that contacts the pressing member 110 or the spring relief 122*g*. Instead, the adjustment member 122 of the second example includes a cross-shaped first spring receiver 122*c* into which an end on a side opposite to the sheet side of the first pressure spring 121 is fitted. Other configurations are common in the first and second examples. In the following description, the configurations common in the first and second examples are described without distinction.

As illustrated in FIGS. 6 and 7A, the pressing force adjustment mechanism 120 of the first and second examples includes the first pressure spring 121, the adjustment member 122, a second pressure spring 123, and a rotary lever 126. The first pressure spring 121 functions as a biasing member to bias the pressing member 110 to a sheet side (i.e., the inner side of the sheet feed tray 5, or referred to as the front side of the image forming apparatus 100) (i.e., the −Y direction). The adjustment member 122 is held by the storage 102*a* so as to be movable in the width direction (i.e., the Y direction) in a given range and adjusts the pressing force by the pressing member 110. The second pressure spring 12.3 functions as a second biasing member to bias the adjustment member 122 to the sheet side (i.e., the −Y direction). The rotary lever 126 is a rotary member and functions as a position changer to move the adjustment member 122 to the side opposite to the sheet side (in other words, the outer side of the sheet feed tray 5, or referred to as the rear side of the image forming apparatus 100) (i.e., the +Y direction) against the biasing force of the second pressure spring 123 to change the position of the adjustment member 122 in the width direction.

Pressure holding protrusions 110*c* are provided on both sides of the pressing member 110 in the sheet conveyance direction (i.e., the X direction). The pressure holding protrusions 110*c* are inserted into respective pressing member holders 133 provided on the storage 102*a*. The first pressure spring 121 is arranged between the pressing member 110 and the adjustment member 122 in the width direction (i.e., the Y direction). A sheet side end of the first pressure spring 121 is fitted into a cross-shaped pressure spring receiver 110*d*. (see FIG. 13) provided on the pressing member 110. In the first example, as illustrated in FIG. 6, the sheet side end opposite to the sheet side of the first pressure spring 121 is fitted into a cross-shaped spring receiver 137 provided on the storage cover 102*c*. In this manner, in the first example, the first pressure spring 121 is held by the pressing member 110 and the storage cover 102*c*.

In the second example, as illustrated in FIG. 7A, the sheet side end on the side opposite to the sheet side of the first pressure spring 121 is fitted into a cross-shaped first spring receiver 122*c* provided on the adjustment member 122. In this manner, the first pressure spring 121 is held by the pressing member 110 and the adjustment member 122.

Adjustment holding protrusions 122*a* are provided on both sides of the adjustment member 122 in the sheet conveyance direction (i.e., the X direction). The adjustment holding protrusions 122*a* are inserted into adjuster holders 134 provided on the storage 102*a*. The second pressure spring 123 is arranged between the adjustment member 122 and the storage cover 102*c* in the width direction (i.e., the Y direction). A sheet side end of the second pressure spring 123 is fitted into a cross-shaped second spring receiver 122*d* provided on the adjustment member 122, and a sheet side end opposite to the sheet side is fitted into a cross-shaped cover spring receiver 136 provided on the storage cover 102*c*. In this manner, the second pressure spring 123 is held by the adjustment member 122 and the storage cover 102*c*.

In a state in which the storage cover 102*c* is attached to the storage 102*a*, the first pressure spring 121 is held by the pressing member 110 and the storage cover in a compressed state in the first example, and the first pressure spring 121 is held by the pressing member 110 and the adjustment member 122 in the compressed state in the second example. In both the first and second examples, the second pressure spring 123 is held by the adjustment member 122 and the storage cover 102*c* in the compressed state.

One end of the rotary lever 126 is rotatably supported by a lever supporting shaft 131 provided on the storage 102*a*. The rotary lever 126 is provided on the side wall of the storage 102*a* on the downstream side in the sheet conveyance direction. The rotary lever 126 penetrates through a lever through hole 132 that extends in the vertical direction. The other end of the rotary lever 126 protrudes from the far side fence 102 to be located above the flat portion 106*b* (refer to FIG. 3) of the movable bottom plate 106.

Figure 8:
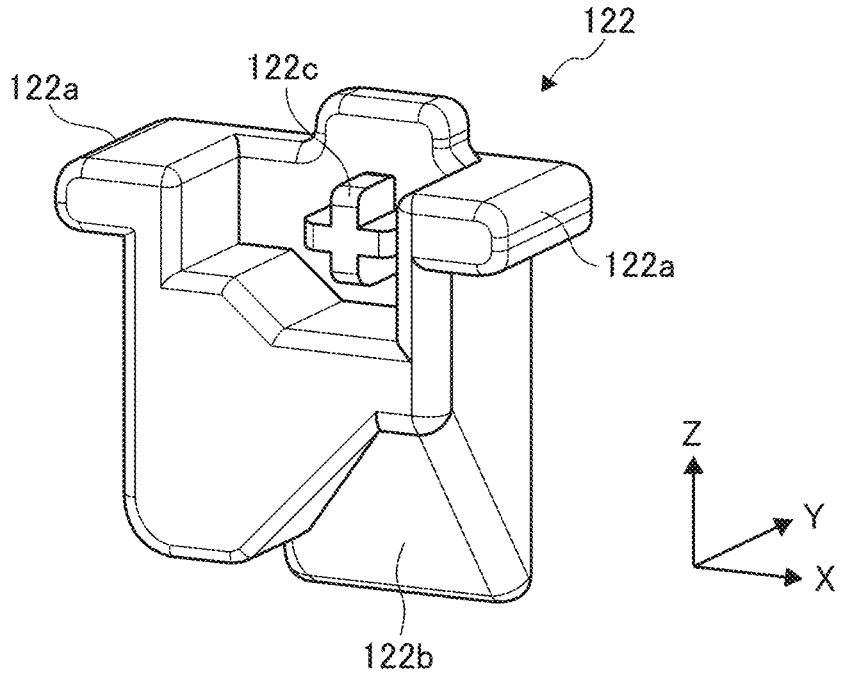
FIG. 8 is a perspective view illustrating an adjustment member according to the second embodiment of this disclosure.

FIG. 8 is a perspective view illustrating the adjustment member 122 according to the second example of the present embodiment of this disclosure.

As illustrated in FIG. 8, a lever contact portion 122*b* is disposed on a lower portion of the adjustment member 122. The rotary lever 126 contacts the lever contact portion 122*b*. The lever contact portion 122*b* has an inclined face inclined (inclined toward the sheet side) so as to be located on the sheet side (i.e., the direction) in an upward direction (i.e., a +Z direction). The adjustment member 122 of the first example also includes a lever contact portion 122*b* that is similar to the lever contact portion 122*b* of the second example (see FIG. 6).

Figure 9:
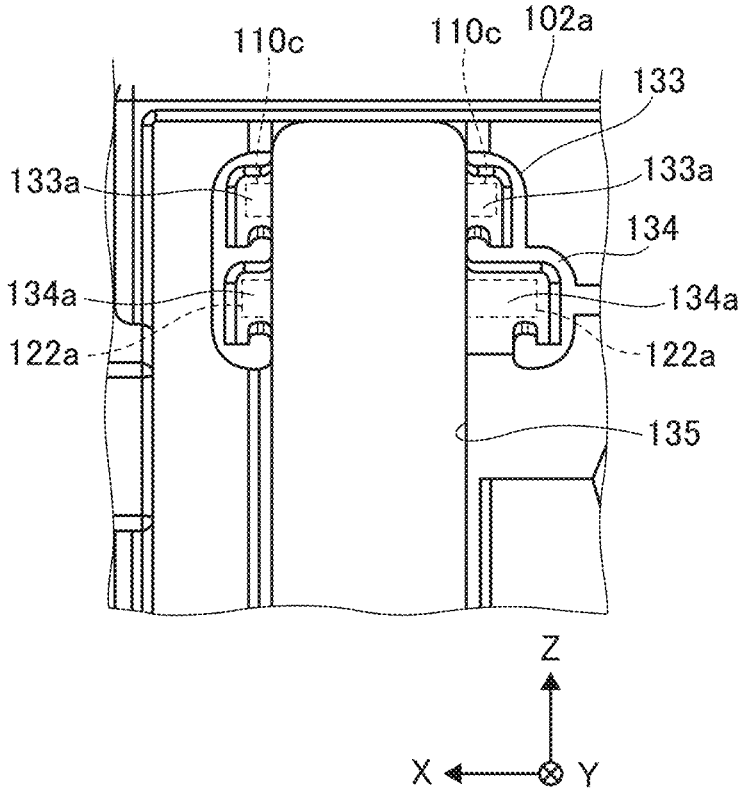
FIG. 9 is a diagram illustrating a main part of the storing portion of the far side fence.

FIG. 9 is a diagram illustrating a main part of the storage 102*a* of the far side fence 102.

The storage 102*a* has a pressure through hole 135 through which the pressing member 110 penetrates. The pressing member holders 133 are provided on both sides across the pressure through hole 135 in the sheet conveyance direction (i.e., the X direction). The pressing member holders 133 include pressure contact faces 133*a* on the sheet side end to which the pressure holding protrusions 110*c* contact.

The adjuster holders 134 are disposed adjacent to the pressing member holders 133 directly below the pressing member holders 133 and are provided on both sides across the pressure through hole 135 in the sheet conveyance direction (i.e., the X direction). Similar to the pressing member holders 133, the adjuster holders 134 include an adjuster contact face 134*a* on the sheet side end to which the adjustment holding protrusions 122*a* contact. The adjuster contact face 134*a* functions as an adjuster regulator or simply a regulator.

Figure 10:
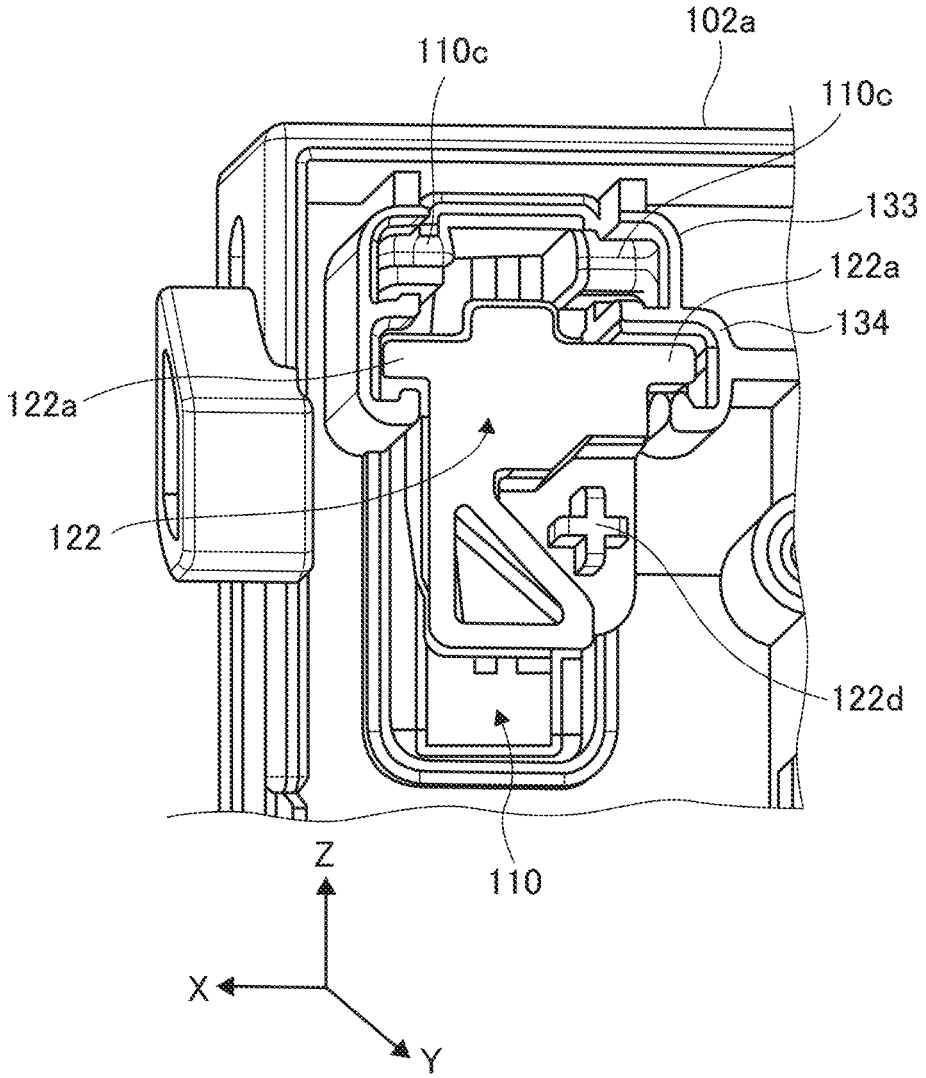
FIG. 10 is a perspective view illustrating the storing portion in which a pressing member and the adjustment member of the second embodiment are provided.

FIG. 10 is a perspective view illustrating the storage 102*a* in which the pressing member 110 and the adjustment member 122 of the second example are provided.

As illustrated in FIG. 10, the pressure holding protrusion 110*c* of the pressing member 110 is inserted into the pressing member holder 133, so that the pressing member 110 is held by the storage 102*a* so as to be movable in the width direction (i.e., the Y direction). The adjustment holding protrusion 122*a* of the adjustment member 122 is inserted into the adjuster holder 134, so that the adjustment member 122 is held by the storage 102*a* so as to be movable in the width direction (i.e., the Y direction).

Since the adjustment member 122 is biased toward the sheet side by the second pressure spring 123, the adjustment holding protrusion 122*a* inserted into the adjuster holder 134 contacts the adjuster contact face 134*a* and movement of the adjustment member 122 toward the sheet side is regulated. Since the pressing member 110 is biased toward the sheet side by the first pressure spring 121, the pressure holding protrusion 110*c* that is inserted into the pressing member holder 133 contacts the pressure contact face 133*a* and movement of the pressing member 110 toward the sheet side is regulated.

In the second example, a spring constant of the second pressure spring 123 is greater than a spring constant of the first pressure spring 121, and the biasing force of the second pressure spring 123 applied to the adjustment member 122 is greater than the biasing force of the first pressure spring 121 applied to the adjustment member 122. As a result, the adjustment holding protrusion 122*a* of the adjustment member 122 reliably contacts the adjuster contact face 134*a*, and a compression length of the first pressure spring 121 is set to a target length. The adjustment holding protrusion 122*a* of the adjustment member 122 contacts the adjuster contact face 134*a*, so that the adjuster contact face 134*a* receives the biasing force of the second pressure spring 123, and the biasing force of the second pressure spring 123 does not act on the pressing member 110. As a result, only the biasing force of the first pressure spring 121 compressed to the target compression length acts on the pressing member 110, and the pressing force to the sheet P is set to a target pressing force.

In the storage 102*a*, the biasing force of the first pressure spring 121 applied when the pressing member 110 is pushed into the storage 102*a* by the sheet bundle loaded on the movable bottom plate 106 becomes smaller than the sum of the biasing force of the second pressure spring 123 and a static frictional force between the adjustment holding protrusion 122*a* and the adjuster holder 134. As a result, even when the pressing member 110 is pushed into the storage 102*a* by the sheet bundle, the adjustment holding protrusion 122*a* contacts the adjuster contact face 134*a*, and the biasing force of the second pressure spring 123 is prevented from acting on the pressing member 110.

In the first example, the contact protrusion 122*f* of the adjustment member 122 contacts the pressing member 110 and allows the biasing force of the second pressure spring 123 to act on the pressing member 110. As a result, when the contact protrusion 122*f* of the adjustment member 122 contacts the pressing member 110, the biasing force of the second pressure spring 123 and the first pressure spring 121 is applied to the sheet bundle loaded on the movable bottom plate 106.

Next, a description is given of an adjusting operation of the pressing force, with reference to the second example. The same adjusting operation of the pressing force is applied to the first example.

Figure 11A:
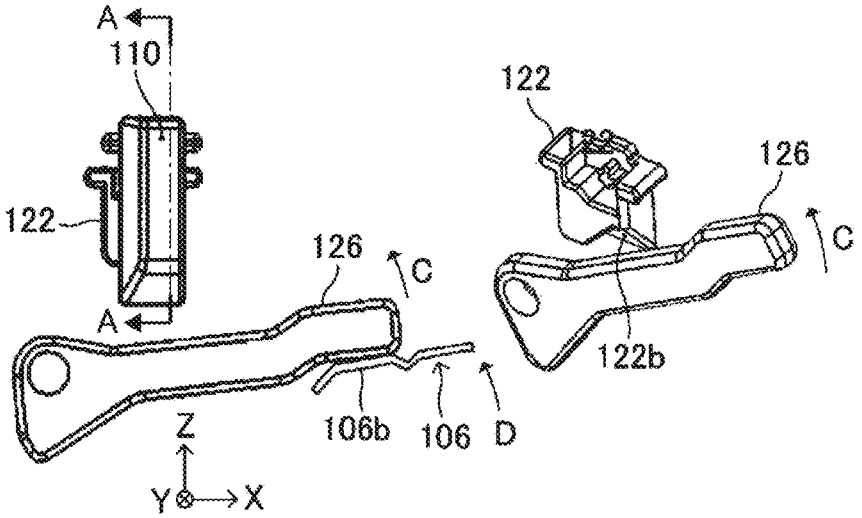
FIGS. 11A, 11B, and 11C are diagrams for explaining an adjusting operation of a pressing force.
Figure 11B:
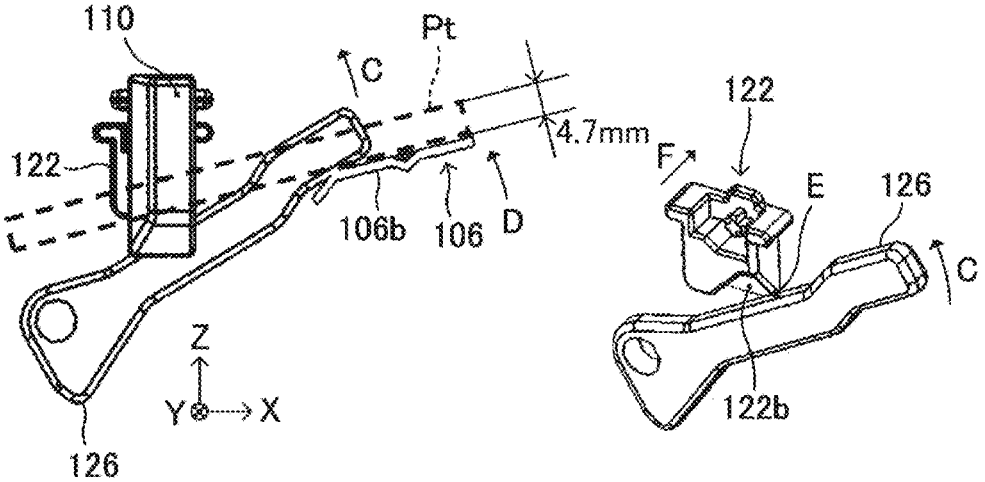
Figure 11C:
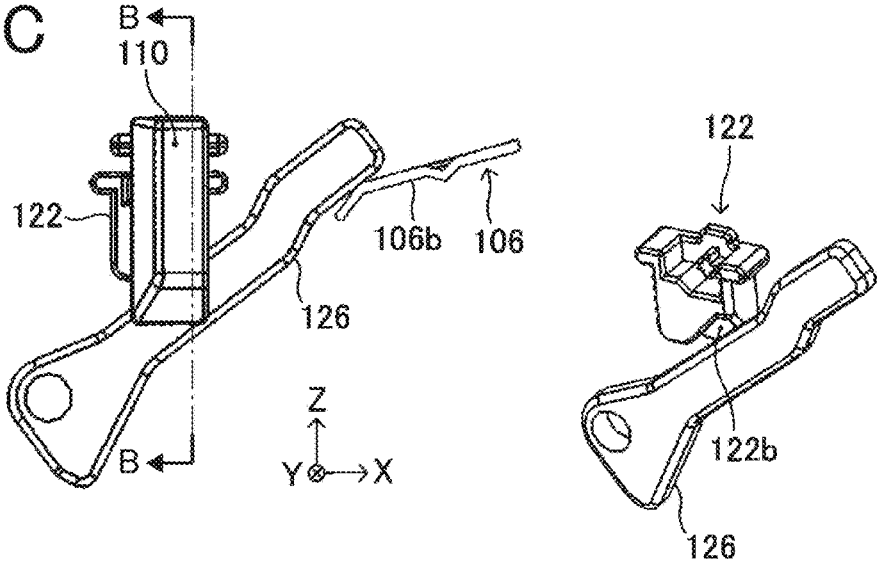

FIGS. 11A, 11B, and 11C are diagrams for explaining the adjusting operation of the pressing force. To be more specific, FIG. 11A is a diagram illustrating a state in which the movable bottom plate 106 is brought into contact with the rotary lever 126. FIG. 11B is a diagram illustrating a state in which the rotary lever 126 is brought into contact with the adjustment member 122. FIG. 11C is a diagram illustrating a state in which the movable bottom plate 106 reaches an uppermost position.

As illustrated in FIG. 11A, when the downstream side of the movable bottom plate 106 in the sheet conveyance direction is lifted, the flat portion 106*b* (see FIG. 3) contacts the rotary lever 126. More specifically, the flat portion 106*b* of the movable bottom plate 106 contacts a portion of the rotary lever 126 protruding from the storage 102*a*. Furthermore, as the downstream side of the movable bottom plate 106 in the sheet conveyance direction is lifted is lifted (in a direction indicated by arrow D) as the number of sheets P loaded on the movable bottom plate 106 decreases, the other end of the rotary lever 126 is lifted by the flat portion 106*b* of the movable bottom plate 106 and the rotary lever 126 rotates in a counterclockwise direction indicated by arrow C in FIGS. 11A and 11B.

As illustrated in FIG. 11B, when a thickness of a sheet bundle Pt loaded on the movable bottom plate 106 reaches a predetermined thickness (for example, 4.7 mm in the present embodiment), the rotary lever 126 contacts the lever contact portion 122*b* of the adjustment member 122 (at a point E in FIG. 11B). From this state, when the movable bottom plate 106 is further lifted as the number of sheets P loaded on the movable bottom plate 106 decreases, and the rotary lever 126 rotates in the direction C in FIG. 11B, the rotary lever 126 pushes in the lever contact portion 122*b* of the inclined face of the rotary lever 126. Then, the adjustment member 122 moves to the side opposite to the sheet side in a direction indicated by arrow F in FIG. 11B against the biasing force of the second pressure spring 123. As a result, the position of the adjustment member 122 in the width direction (i.e., the Y direction) is changed.

Thereafter, when the rotary lever 126 rotates as the movable bottom plate 106 is lifted, the adjustment member 122 is pushed into the side opposite to the sheet side, and the rotary lever 126 relatively moves the lever contact portion 122*b* of the inclined face of the rotary lever 126. When the lowermost sheet P (in other words, the last sheet P) loaded on the movable bottom plate 106 is fed, the state of the rotary lever 126 and the adjustment member 122 moves to the state illustrated in FIG. 11C.

Figure 12A:
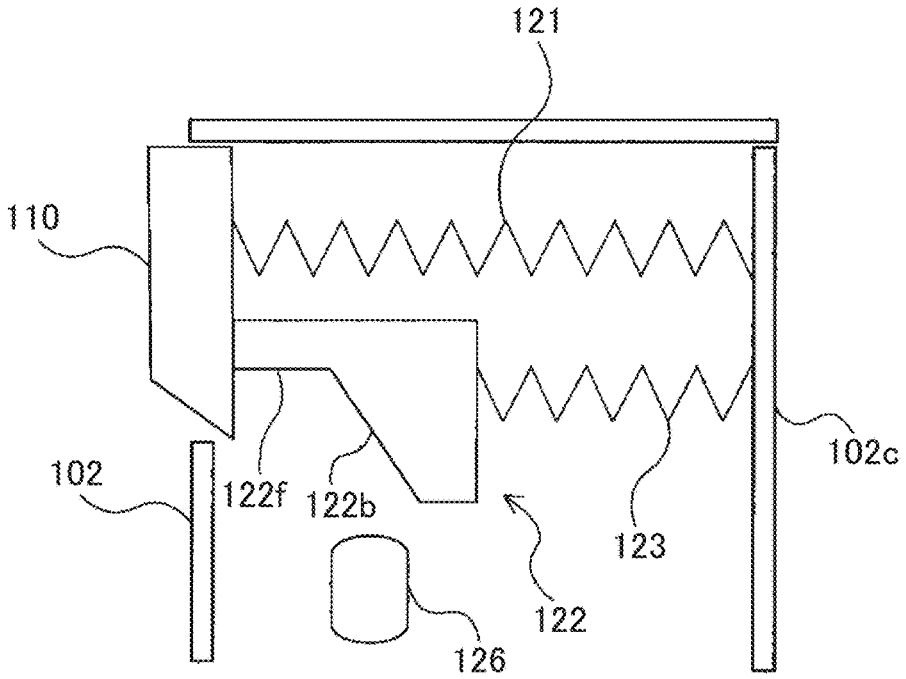
FIG. 12A is a schematic cross-sectional view illustrating the pressing member of the first embodiment, along a line A-A of FIG. 11A in the first embodiment.
Figure 12B:
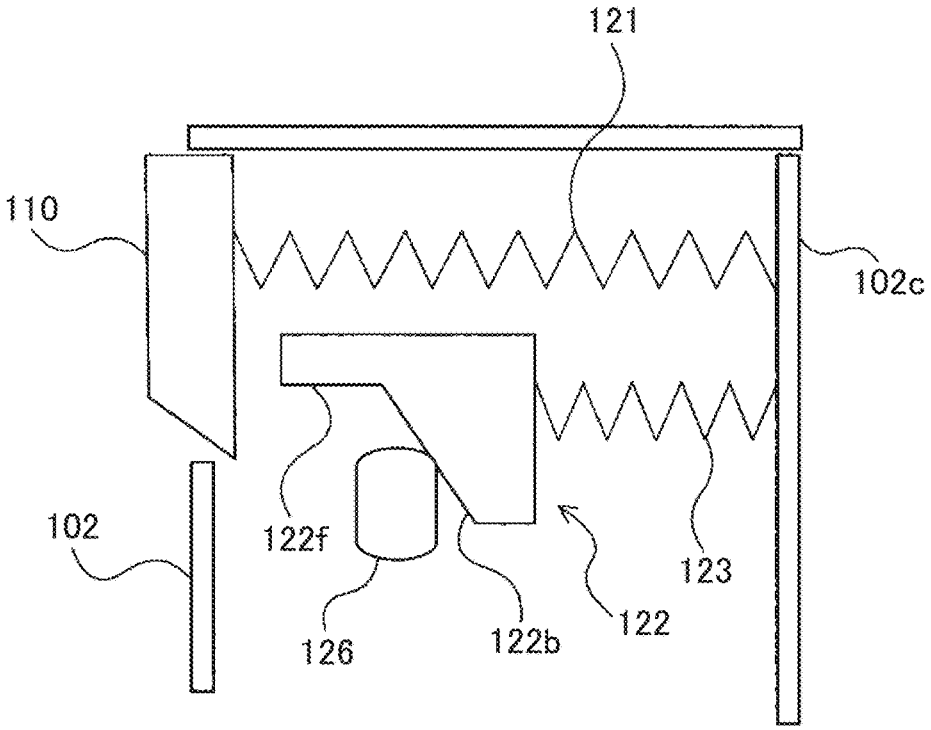
FIG. 12B is a schematic cross-sectional view illustrating the pressing member of the first embodiment, along a line B-B of FIG. 11C in the first embodiment.
Figure 13:
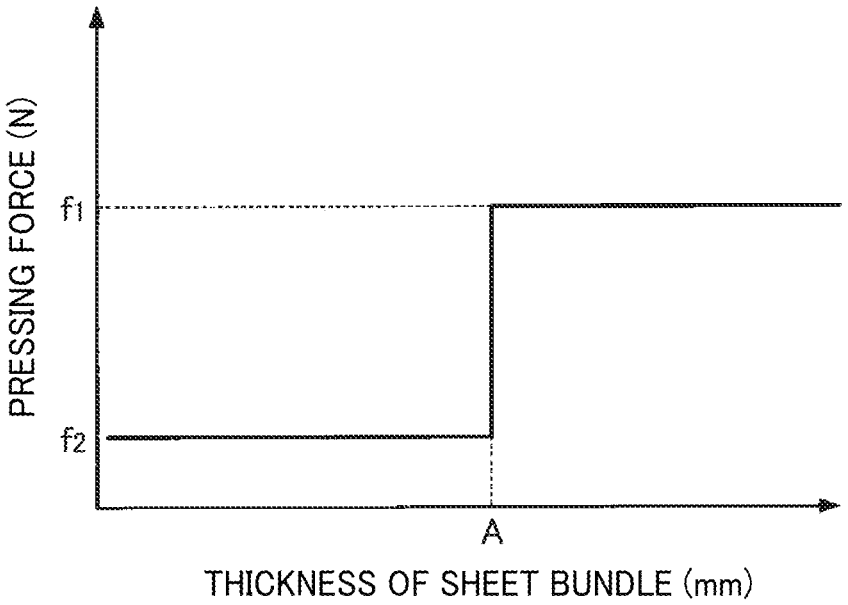
FIG. 13 is a graph illustrating a relation of the pressing force of the pressing member and a thickness of a sheet bundle (the number of sheets) loaded on the movable bottom plate in the first embodiment.

FIG. 12A is a schematic cross-sectional view illustrating the pressing member 110 and the adjustment member 122 of the first example, along a line A-A of FIG. 11A. FIG. 12B is a schematic cross-sectional view illustrating the pressing member 110 and the adjustment member 122 of the first example, along a line B-B of FIG. 11C. FIG. 13 is a graph illustrating a relation of the pressing force of the pressing member 110 and a thickness of the sheet bundle (the number of sheets) loaded on the movable bottom plate 106 in the first example.

As illustrated in FIG. 12A, before the rotary lever 126 contacts the adjustment member 122, the contact protrusion 122*f* of the adjustment member 122 contacts the pressing member 110, and the pressing member 110 is biased by the first pressure spring 121 and the second pressure spring 123.

As illustrated in FIG. 12B, the rotary lever 126 contacts the adjustment member 122 and displaces the adjustment member 122 to the side opposite to the sheet side, so that the contact protrusion 122*f* of the adjustment member 122 is separated from the pressing member 110. As a result, the pressing member 110 is biased by the first pressure spring 121 alone. As a result, the pressing force applied to the sheet (or the sheet bundle Pt) by the pressing member 110 is decreased.

In this manner, in the first example, when the thickness of the sheet bundle Pt loaded on the movable bottom plate 106 reaches a predetermined thickness A (see FIG. 13, for example, 4.7 mm in the present embodiment), the rotary lever 126 contacts the adjustment member 122. As the number of sheets of sheets in the sheet bundle Pt decreases, the adjustment member 122 is displaced to the side opposite to the sheet side, and the contact protrusion 122*f* of the adjustment member 122 is separated from the pressing member 110. As a result, the pressing force to the sheets (i.e., the sheet bundle Pt) by the pressing member 110 is switched from a biasing force f1 of the second pressure spring 123 and the first pressure spring to a biasing force f2 of the first pressure spring 121 alone, and the pressing force to the sheet (i.e., the sheet bundle Pt) by the pressing member 110 decreases. That is, as illustrated in FIG. 13, the pressing force changes (decreases) in a rectangular manner when the thickness of the sheet bundle Pt becomes the predetermined thickness A.

As a result, the pressing force to the sheet (i.e., the sheet bundle Pt) by the pressing member 110 is reduced in accordance with a decrease in stiffness of the sheet bundle Pt in association with the decrease in the number of sheets of the sheet bundle Pt, and therefore the sheet bundle Pt is prevented from buckling due to the pressing force of the pressing member 110. Accordingly, the sheet P is restrained from being fed in a bent state, and therefore occurrence of wrinkles of the sheet P and disturbance of the image position in the width direction are prevented.

Further, in the first example, when the number of sheets of the sheet bundle Pt loaded on the movable bottom plate 106 becomes smaller, the adjustment member 122 that biases the pressing member 110 is simply moved to the side opposite to the sheet side to separate the adjustment member 112 from the pressing member 110 to switch the biasing force applied to the pressing member 110. Therefore, the biasing force of the first pressure spring 121 acts on the pressing member 110 to the lowermost sheet of the sheet bundle Pt. As a result, without causing the pressing member 110 to retract into the far side fence 102, the pressing face 110*b* of the pressing member 110 is brought into contact with the end in the width direction of the sheet to the lowermost sheet of the sheet bundle Pt. Therefore, to the lowermost sheet of the sheet bundle Pt, the sheet is pressed by the pressing member 110 toward the near side fence 101 and the position in the width direction (i.e., the Y direction) regulated by the pressing member 110 and the near side fence 101. As a result, the sheet feeding position in the width direction of the sheet P is aligned to the lowermost sheet of the sheet bundle Pt, and the image forming position on the sheet P in the width direction is prevented from being disturbed.

When no sheet is detected and the movable bottom plate 106 is lowered from the position in the state illustrated in FIG. 11C to move to a lowermost position, the rotary lever 126 rotates in a direction opposite to the direction indicated in FIGS. 11A to 11C due to, for example, the weight of the rotary lever 126. Then, the adjustment member 122 moves toward the sheet side by the biasing force of the second pressure spring 123, and the contact protrusion 122*f* of the adjustment member 122 contacts the pressing member 110. As a result, the pressing member 110 is biased by the biasing force of the first pressure spring 121 and the second pressure spring 123, and the pressing force of the pressing member 110 returns to an initial state (i.e., a state before the pressing force decreases).

Figure 14A:
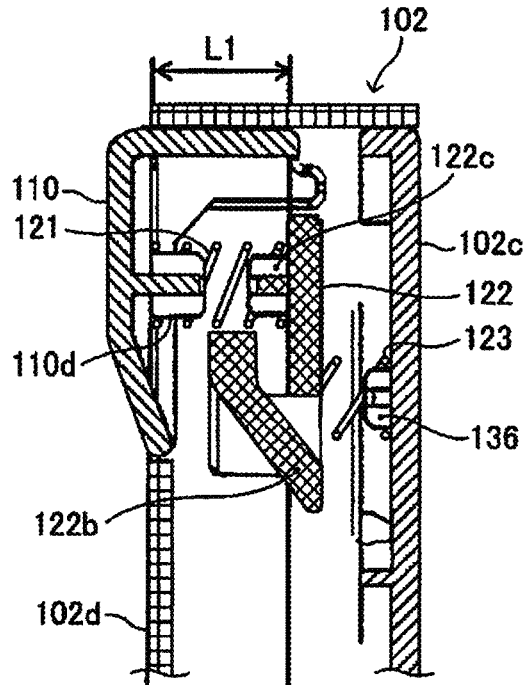
FIG. 14 including FIGS. 14(*a*) and 14(*b*) is a cross-sectional view illustrating the pressing member according to the second embodiment, where FIG. 14(*a*) illustrates the pressing member along the line A-A of FIG. 11A and FIG. 14(*b*) illustrates the pressing member along the line B-B of FIG. 11C.
Figure 14B:
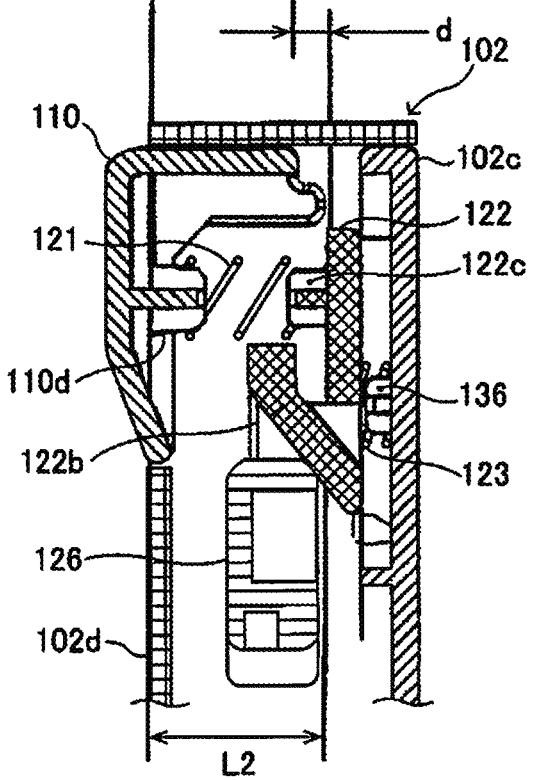
Figure 15:
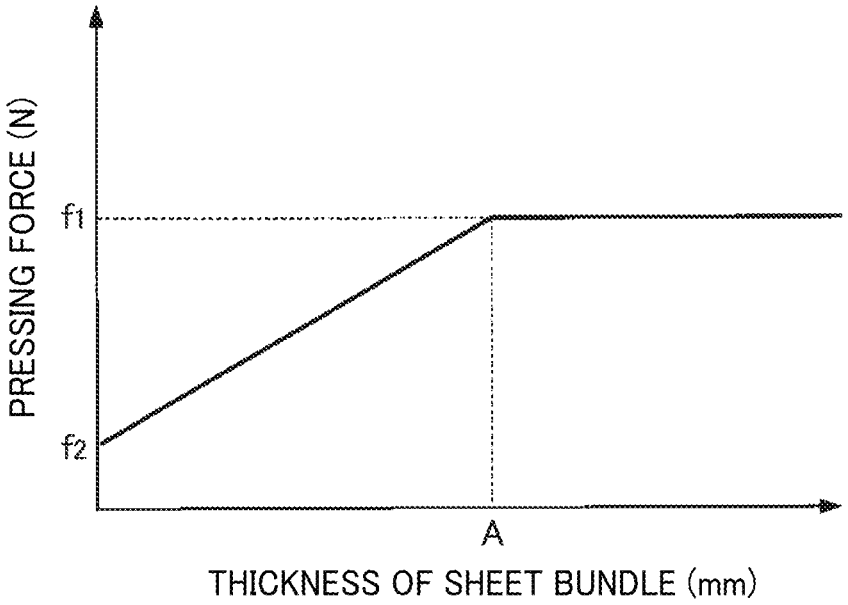
FIG. 15 is a graph illustrating a relation of the pressing force of the pressing member and a thickness of a sheet bundle (the number of sheets) loaded on the movable bottom plate in the second embodiment.

FIG. 14 including FIGS. 14(*a*) and 14(*b*) is a cross-sectional view illustrating the pressing member 110 and the adjustment member 122 according to the second example, where FIG. 14(*a*) illustrates the pressing member 110 and the adjustment member 122 along the line A-A of FIG. 11A and FIG. 14(*b*) illustrates the pressing member 110 and the adjustment member 122 along the line B-B of FIG. 11C. FIG. 15 is a graph illustrating a relation of the pressing force of the pressing member 110 and a thickness of a sheet bundle (the number of sheets) loaded on the movable bottom plate 106 in the second example.

As illustrated in FIG. 14(*a*), the length of the first pressure spring 121 is L1 [mm] before the rotary lever 126 contacts the adjustment member 122. Thereafter, the rotary lever 126 contacts the adjustment member 122 and displaces the adjustment member 122 to the side opposite to the sheet side, so that the compressed first pressure spring 121 extends and the biasing force of the first pressure spring 121 decreases. As a result, the pressing force to the sheet (of the sheet bundle) by the pressing member 110 is reduced.

Finally, as illustrated in FIG. 14(*b*), the length of the first pressure spring 121 extends from L1 [mm] to L2 [mm], and a compression amount of the first pressure spring 121 decreases by d [mm]. Even in the state illustrated in FIG. 14(*b*), the first pressure spring 121 is in the compressed state and biases the pressing member 110 toward the sheet side. In the present embodiment, the biasing force of the first pressure spring 121 in FIG. 14(*a*) is 1.6 [N], and the biasing force of the first pressure spring 121 in FIG. 14(*b*) is 0.8 [N].

As illustrated in FIG. 15, in the second example, from when the thickness of the sheet bundle Pt loaded on the movable bottom plate 106 reaches the predetermined thickness A (for example, 4.7 mm in the present embodiment), the adjustment member 122 is displaced to the side opposite to the sheet side as the number of sheets in the sheet bundle Pt decreases, the compression amount of the first pressure spring 121 gradually decreases, and the pressure to the sheet (of the sheet bundle Pt) by the pressing member 110 gradually decreases. As a result, the pressing force to the sheet (of the sheet bundle Pt) by the pressing member 110 is reduced in accordance with a decrease in stiffness of the sheet bundle Pt in association with the decrease in the number of sheets of the sheet bundle Pt. Therefore, the sheet bundle Pt is prevented from being buckled by the pressing force of the pressing member 110. Accordingly, the sheet is prevented from being fed in a bent state, and therefore occurrence of wrinkles of the sheet and disturbance of the image position in the width direction are prevented.

In the second example, the adjustment member 122, which is a member that holds the end on the side opposite to the sheet side of the first pressure spring 121, is moved to the side opposite to the sheet side to adjust the pressing force. As a result, without causing the pressing member 110 to retract into the far side fence 102, the pressing face 110*b* of the pressing member 110 is brought into contact with the end in the width direction of the sheet to the lowermost sheet of the sheet bundle Pt. Therefore, to the lowermost sheet of the sheet bundle Pt, the sheet is pressed toward the near side fence 101 by the pressing member 110 and the position on the sheet in the width direction (i.e., the Y direction) is regulated by the pressing member 110 and the near side fence 101. As a result, the sheet feeding position of the sheet in the width direction of the sheet is aligned to the lowermost sheet of the sheet bundle Pt, and the image forming position on the sheet in the width direction is prevented from being disturbed.

When no sheet is detected and the movable bottom plate 106 is lowered from the state illustrated in FIG. 11C to move to the lowermost position, the rotary lever 126 rotates in the direction opposite to the direction indicated in FIGS. 11A to 11C due to, for example, the weight of the rotary lever 126. The adjustment member 122 moves to the sheet side by the biasing force of the second pressure spring 123 and compresses the first pressure spring 121. Then, the state of the rotary lever 126 and the adjustment member 122 moves to the state illustrated in FIG. 11A, and the pressing force of the pressing member 110 returns to the initial state (i.e., the state before the pressing force is reduced).

In this manner, the second pressure spring 123 biases the adjustment member 122 toward the sheet side, so that the adjustment member 122 is automatically displaced to the sheet side when changing the state from FIG. 11C to FIG. 11A, thereby returning to the state illustrated in FIG. 11A.

In the present embodiment, the second pressure spring 123 and the rotary lever 126 displace the position of the adjustment member 122 in the width direction to adjust the pressing force. However, for example, the configuration to adjust the pressing force is not limited to the above-described configuration. For example, the position of the adjustment member 122 in the width direction may be displaced by using a drive source such as an actuator to adjust the pressing force.

When the number of sheets of the sheet bundle Pt remaining on the movable bottom plate 106 decreases, the configuration of the first example is employed, in which the pressing force of the pressing member 110 decreases in the rectangular manner. The configuration of the first example provides the following effects when compared with the configuration of the second example, in which the pressing force gradually decreases when the number of sheets of the sheet bundle Pt remaining on the movable bottom plate 106 decreases. To be more specific, in the second example, a displacement amount of the adjustment member 122 to the side opposite to the sheet side in accordance with the decrease in the number of sheets of the sheet bundle Pt varies due to assembly errors and manufacturing errors of the adjustment member 122, the rotary lever 126, and the movable bottom plate 106. As a result, it is likely that the variation in the pressing force of the pressing member 110 becomes large when the number of remaining sheets of the sheet bundle Pt decreases. Further, an optimal pressing force is kept by the biasing force of the first pressure spring 121, from when the number of sheets of the sheet bundle Pt is large to when the lowermost sheet is left. Therefore, it is likely to be difficult to select the first pressure spring 121.

By contrast, in the configuration of the first example, when the number of remaining sheets the sheet bundle Pt loaded on the movable bottom plate 106 decreases, the adjustment member 122 is separated from the pressing member 110 to switch the biasing force applied to the pressing member 110. Therefore, the variation in the displacement amount of the adjustment member 122 to the side opposite to the sheet side in accordance with the decrease in number of sheets of the sheet bundle Pt of the adjustment member 122 does not affect the pressing force of the pressing member 110. According to the configuration of the first example, accurate assembly and manufacturing of the adjustment member 122, the rotary lever 126, and the movable bottom plate 106 are not performed, and therefore the amount of costs of the image forming apparatus 100 is reduced. Further, when the number of sheets of the sheet bundle is large, the pressing member 110 is biased by a plurality of pressure springs, and therefore a sufficiently large pressing force is applied. Therefore, when the number of sheets of the sheet bundle is large, the position of the sheet in the width direction is regulated excellently by the pressing member 110 and the near side fence 101.

On the other hand, in the configuration of the second example, when the number of remaining sheets of the sheet bundle Pt loaded on the movable bottom plate 106 becomes small, the pressing force changes according to the number of sheets of the sheet bundle Pt. Therefore, the sheets of the sheet bundle Pt loaded on the movable bottom plate 106 is pressed toward the near side fence 101 by an optimum pressing force according to the number of remaining sheets of the sheet bundle Pt. As a result, after the number of remaining sheets of the sheet bundle Pt loaded on the movable bottom plate 106 has decreased and the pressing force has changed, the position of the sheet in the width direction (i.e., the Y direction) is regulated reliably by the pressing member 110 and the near side fence 101 to the lowermost sheet of the sheet bundle Pt and the buckling of the sheet is inhibited, when compared with the configuration of the first example, in which the pressing force is evenly applied to the lowermost sheet of the sheet bundle Pt.

Figure 16A:
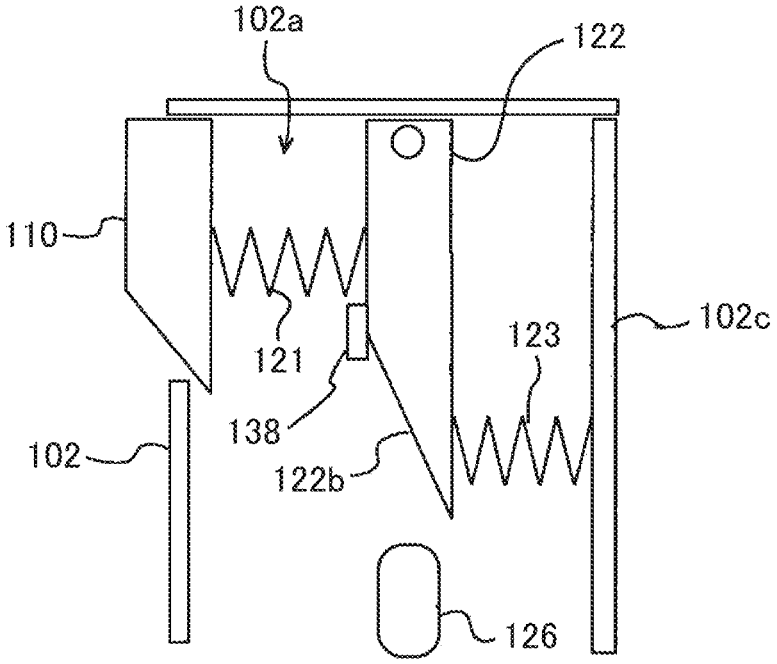
FIGS. 16A and 16B are diagrams illustrating a schematic configuration of the pressing member of a variation of the embodiments of this disclosure.
Figure 16B:
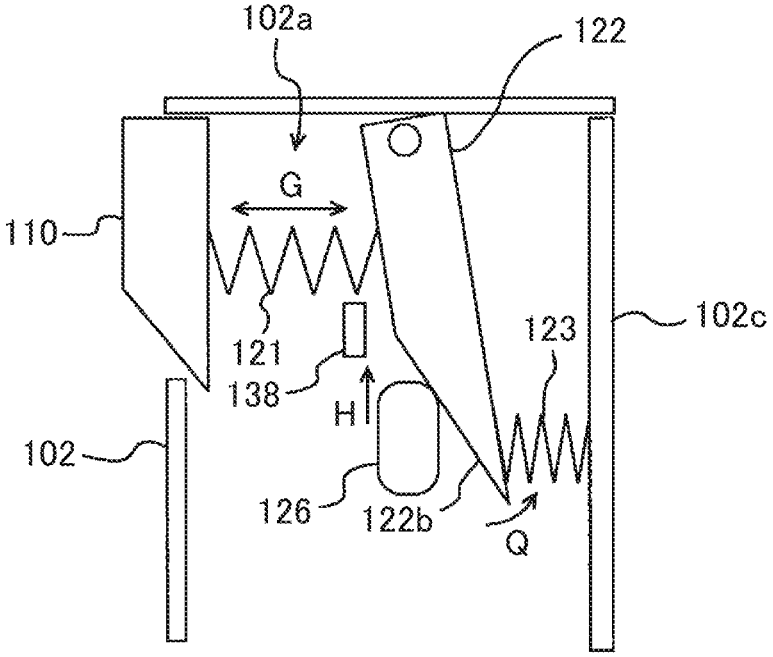

FIGS. 16A and 16B are diagrams illustrating a schematic configuration of the pressing member 110 and the adjustment member 122 of a variation of the present embodiment of this disclosure.

As illustrated in FIGS. 16A and 16B, in this variation, the adjustment member 122 is rotatably supported by the storage 102*a*.

Also in this variation, when the rotary lever 126 is not in contact with the adjustment member 122, the adjustment member 122 is in contact with a regulator 138 provided in the storage 102*a*, and rotation of the adjustment member 122 in the clockwise direction in FIGS. 16A and 16B by the biasing force of the second pressure spring 123 is regulated. As a result, the first pressure spring 121 is compressed to the target length and biases the pressing member 110 with a specified biasing force.

Then, as illustrated in FIG. 16B, when the rotary lever 126 rotates as the movable bottom plate 106 is lifted to contact the lever contact portion 122*b* of the adjustment member 122 to push in the lever contact portion 122*b*, the adjustment member 122 rotates in the counterclockwise direction in FIG. 16B, as indicated by arrow Q in FIG. 16B, against the biasing force of the second pressure spring 123. As a result, from the state illustrated in FIG. 16A, the first pressure spring 121 extends in directions indicated by arrow G in FIG. 16B, and the compression amount of the first pressure spring 121 decreases and the biasing force of the second pressure spring 123 decreases. As a result, the pressing force applied by the pressing member 110 to the sheet (of the sheet bundle) decreases, and the sheet bundle is prevented from buckling due to the pressing force applied by the pressing member 110.

Similarly, in this variation, without causing the pressing member 110 to retract into the far side fence 102, the pressing face 110*b* of the pressing member 110 is brought into contact with the end in the width direction of the sheet bundle to the lowermost sheet of the sheet bundle to press the sheet toward the near side fence 101 by the pressing member 110. Therefore, the position of the sheet in the width direction (i.e., the Y direction) is regulated by the pressing member 110 and the near side fence 101 to the lowermost sheet of the sheet bundle.

In present embodiment, the pressing member 110 and the pressing force adjustment mechanism 120 are provided on the far side fence 102. However, the pressing member 110 and the pressing force adjustment mechanism 120 may also be provided on the near side fence 101 or both the near side fence 101 and the far side fence 102.

In the above description, the examples of the present embodiment are applied to the sheet feed tray 5 of the image forming apparatus TOO. However, this disclosure may also be applied to a bypass sheet feed tray and a document feed tray provided in an automatic document feeder (ADF).

A description is given of an example of a bypass sheet feed tray that is applicable to this disclosure.

Figure 17A:
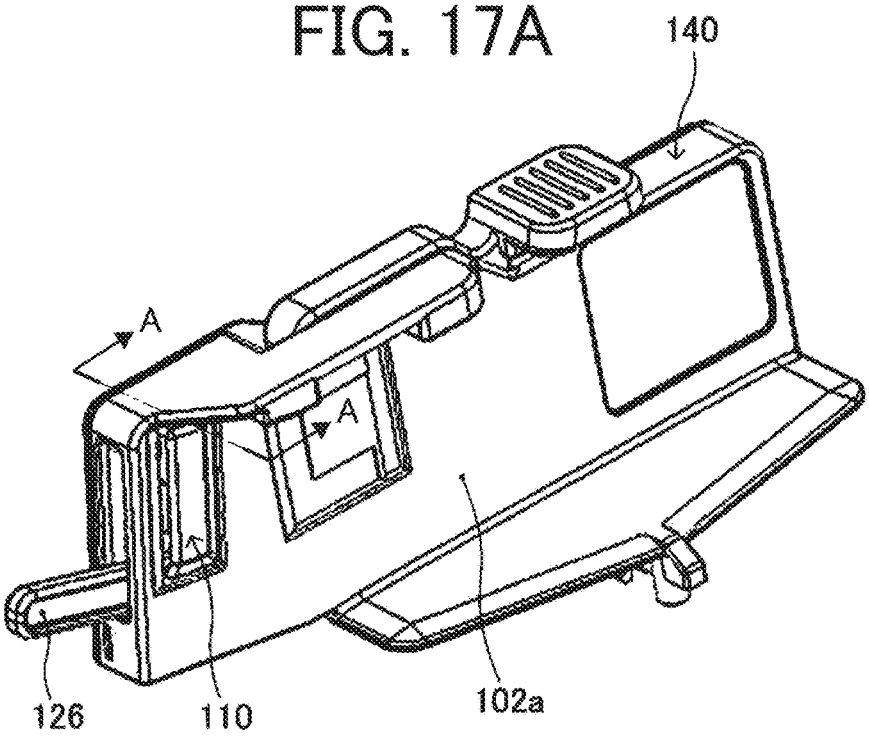
FIG. 17A is a perspective view illustrating one of a pair of bypass side fences provided on a bypass sheet feed tray.
Figure 17B:
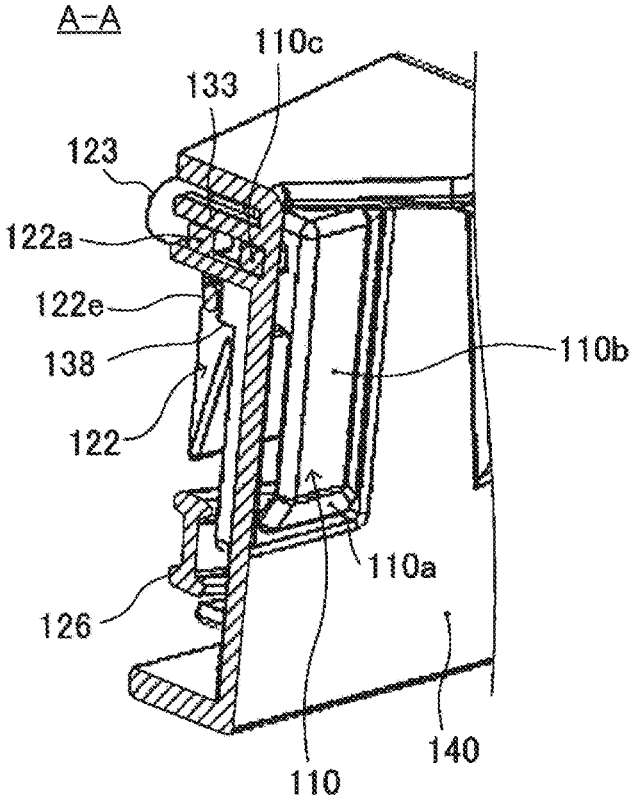
FIG. 17B is a cross-sectional view illustrating the one of the pair of bypass side fences of FIG. 17A, along line A-A of FIG. 17A.

FIG. 17A is a perspective view illustrating one of a pair of bypass side fences 140 provided on a bypass sheet feed tray. FIG. 17B is a cross-sectional view illustrating the one of the pair of bypass side fences 140 of FIG. 17A, along line A-A of FIG. 17A.

Figure 18A:
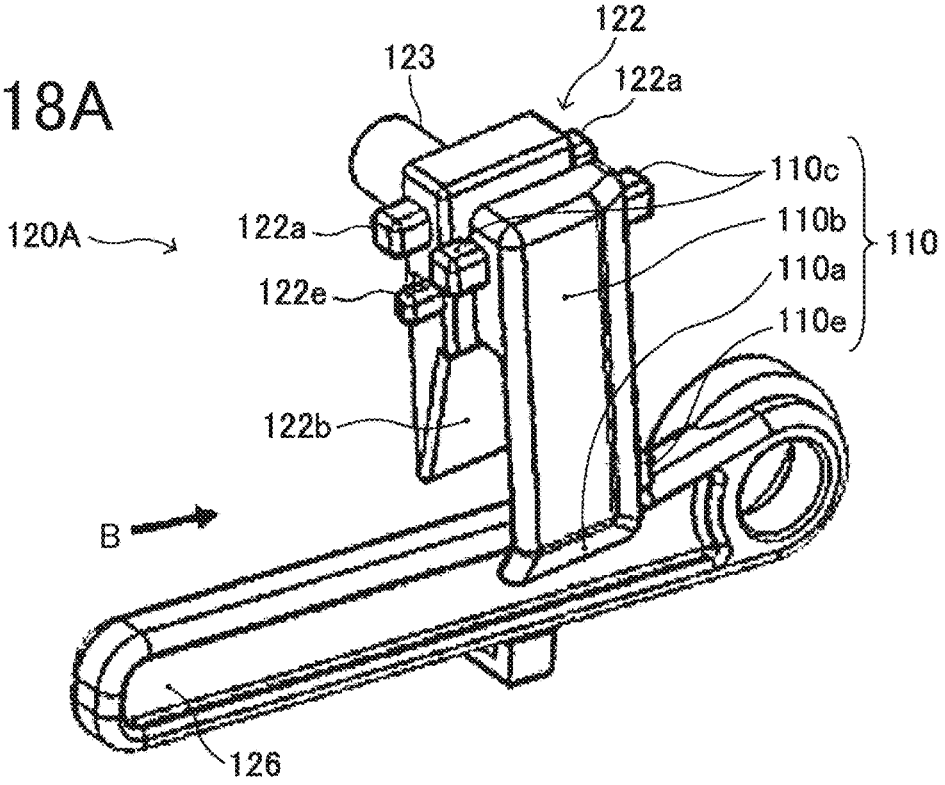
FIG. 18A is a perspective view illustrating a pressing force adjustment mechanism contained in the pair of bypass side fences.
Figure 18B:
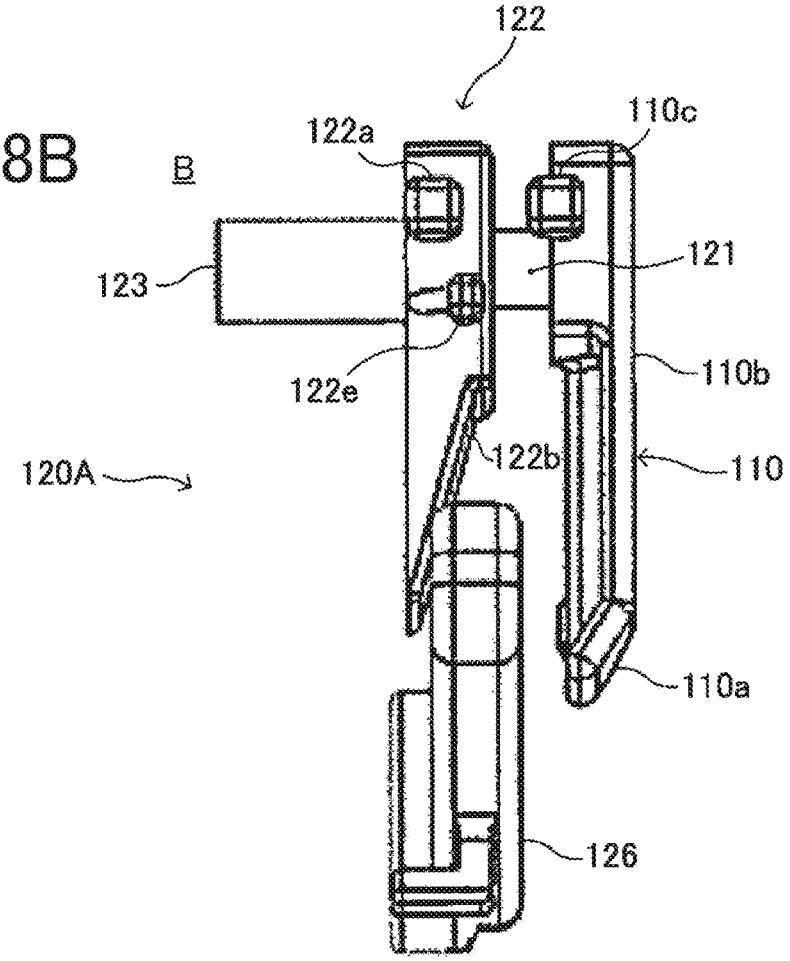
FIG. 18B is a diagram illustrating the pressing force adjustment mechanism of FIG. 18A, viewed in a direction B of FIG. 18A.

FIG. 18A is a perspective view illustrating a pressing force adjustment mechanism 120A contained in the pair of bypass side fences 140. FIG. 18B is a diagram illustrating the pressing force adjustment mechanism 120A of FIG. 18A, viewed in a direction B of FIG. 18A.

Since the bypass sheet feed tray has a smaller loadable number of sheets than the number of sheets of the sheet feed tray 5, one of the pair of bypass side fences 140 is lower in height than the far side fence 102 of the sheet feed tray 5. (Hereinafter, the pair of bypass side fences 140 is occasionally referred to in a singular form as a "bypass side fence 140.) Therefore, as illustrated in FIG. 17B, the adjustment member 122 is held so as to be movable in the width direction by the pressing member holder 133 that holds the pressing member 110. With this configuration, the pressing force adjustment mechanism 120A that functions as a pressing force adjusting device is accommodated in the bypass side fence 140 having such low height. Specifically, the adjustment holding protrusions 122*a* provided on both sides in the sheet conveyance direction of the adjustment member 122 are inserted into the pressing member holder 133 to hold the adjustment member 122 so as to be movable in the width direction.

As a result, the pressing force adjustment mechanism is reduced in height when compared with a configuration in which the adjuster holder 134 that holds the adjustment member 122 so as to be movable in the width direction is provided directly below the pressing member holder 133. With this configuration, the pressing force adjustment mechanism 120A is provided on the side fence having little space in height such as the bypass side fence 140.

Also, by holding the adjustment member 122 by the pressing member holder 133, different from the pressing force adjustment mechanism 120 illustrated in FIGS. 7A to 13, movement of the adjustment member 122 toward the sheet side by the second pressure spring 123 is not regulated by contacting the adjustment holding protrusion 122*a*. Therefore, in the pressing force adjustment mechanism 120A, a contact protrusion 122*e* is provided below the adjustment holding protrusion 122*a*. The contact protrusion 122*e* contacts the regulator 138 provided below the pressing member holder 133 of the bypass side fence 140, so as to regulate the movement of the adjustment member 122 toward the sheet side by the second pressure spring 123.

As a result, the regulator 138 receives the biasing force of the second pressure spring 123, thereby preventing the biasing force of the second pressure spring 123 from acting on the pressing member 110. Therefore, only the biasing force of the first pressure spring 121 compressed to the target compression length acts on the pressing member 110, and the pressing force to the sheet is set to the target pressure.

In the pressing force adjustment mechanism 120A, as illustrated in FIG. 18B, a position of the first pressure spring 121 and a position of the second pressure spring 123 are substantially set to the same position in a direction of the pressing force adjustment mechanism 120A. Further, the first pressure spring 121 and the second pressure spring 123 are arranged substantially on the same straight line along the width direction. In other words, the first pressure spring 121 and the second pressure spring 123 bias the adjustment member 122 on the substantially same line along the width direction. As a result, the biasing force of the first pressure spring 121 applied to the adjustment member 122 and the biasing force of the second pressure spring 123 are applied substantially collinear. As a result, the adjustment member 122 is prevented from generation of useless rotation moment, and the adjustment holding protrusion 122*a* of the adjustment member 122 is prevented from being twisted in the pressing member holder 133. Accordingly, the adjustment member 122 is moved smoothly in the width direction.

Figure 19A:
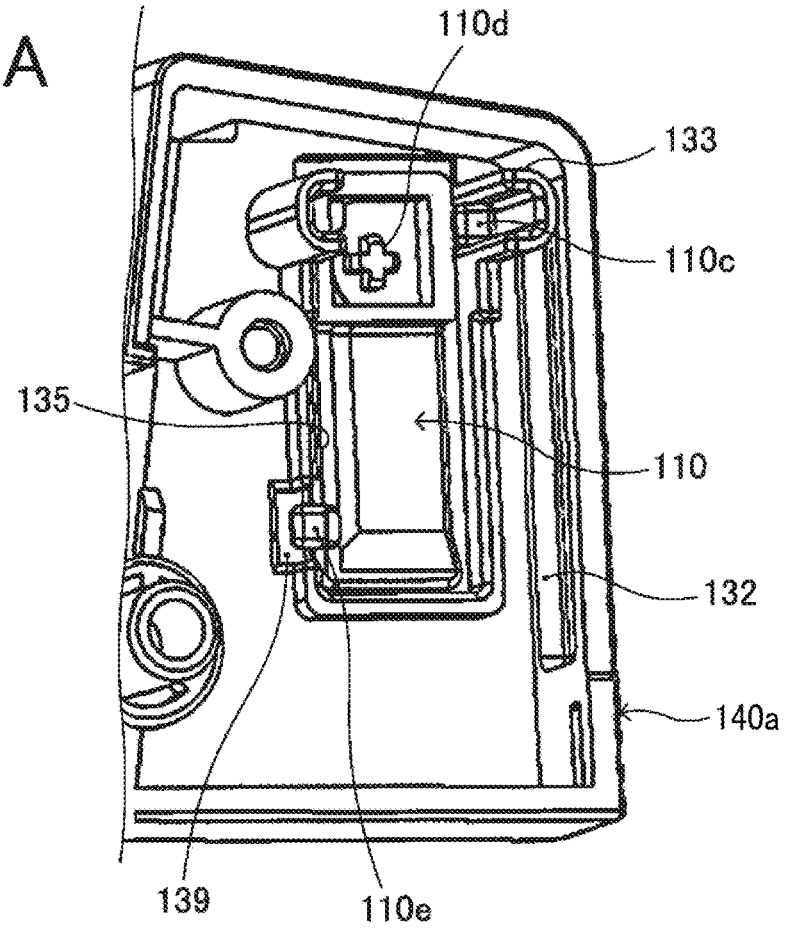
FIG. 19A is a perspective view illustrating a storing unit of the one of the pair of bypass side fences and the pressing member provided on the one of the pair of bypass side fences.
Figure 19B:
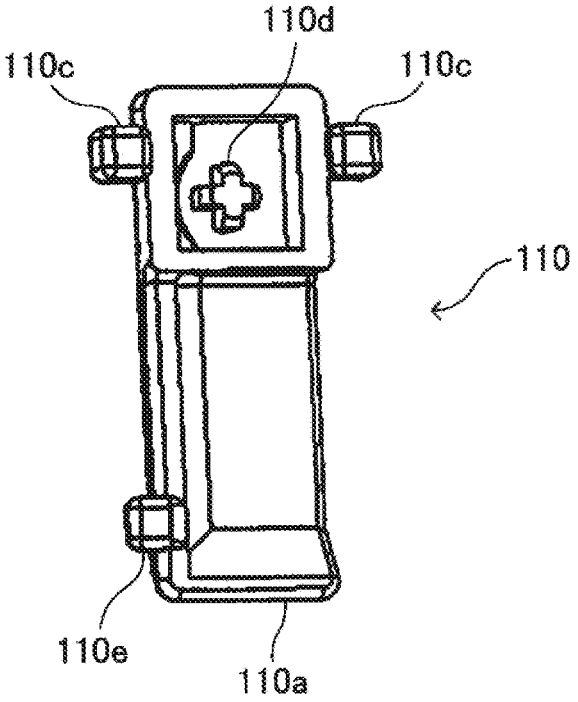
FIG. 19B is a perspective view illustrating the pressing member of FIG. 19A.

FIG. 19A is a perspective view illustrating a storage 140*a* of the bypass side fence 140 and the pressing member 110 provided on the bypass side fences 140. FIG. 19B is a perspective view illustrating the pressing member 110 of FIG. 19A.

In the pressing member 110 provided on the bypass side fence 140, the bypass side fence 140 is lower in height than the far side fence 102 provided on the sheet feed tray 5. Therefore, different from the pressing member 110 provided on the far side fence 102 of the sheet feed tray 5, the inclined face 110*a* of the pressing member 110 is not extended longer in the vertical direction. Therefore, when a lower portion of the pressing member 110 moves to the sheet side closer than an upper portion of the pressing member 110 by rotation of the pressing member 110 about the pressure holding protrusion 110*c*, it is likely that the lower end of the pressing member 110 protrudes from a sheet regulating face of the bypass side fence 140 (in other words, the lower end of the pressing member 110 comes out of the pressure through hole 135). If a bottom plate 141 of the bypass sheet feed tray is lifted with the lower end protruding in this manner, it is likely that the sheet bundle Pt is caught by the lower end of the pressing member 110, which results in disturbance of elevation of the sheet bundle Pt loaded on the bottom plate 141 of the bypass sheet feed tray.

In order to prevent the lower end of the pressing member 110 from protruding from the sheet regulating face of the bypass side fence 140 (in other words, from coming out from the pressure through hole 135) in this manner, as illustrated in FIGS. 19A and 19B, a pressure regulating protrusion 110*e* is provided at the upstream end of the lower portion of the pressing member 110 in the sheet conveyance direction. The pressure regulating protrusion 110*e* contacts a pressing member lower end regulating face 139 of the bypass side fence 140.

As a result, when the pressing member 110 is not pressing the sheet bundle set on the bypass sheet feed tray, the pressure holding protrusion 110*c* of the pressing member 110 contacts the pressure contact face 133*a* (see FIG. 9) of the pressing member holder 133 and the pressure regulating protrusion 110*e* contacts the pressing member lower end regulating face 139. As a result, movement of the lower portion of the pressing member 110 toward the sheet side is regulated, and therefore the lower end of the pressing member 110 is prevented from protruding from the sheet regulating face of the bypass side fence 140 (in other words, from coming out from the pressure through hole 135) by the rotation about the pressure holding protrusion 110*c*. According to this configuration, the sheet bundle is prevented from being caught by the lower end of the pressing member 110 when the bottom plate 141 of the bypass sheet feed tray is lifted.

Next, a description is given of an adjusting operation of the pressing force by the pressing force adjustment mechanism 120A provided on the bypass side fence 140.

Figure 20A:
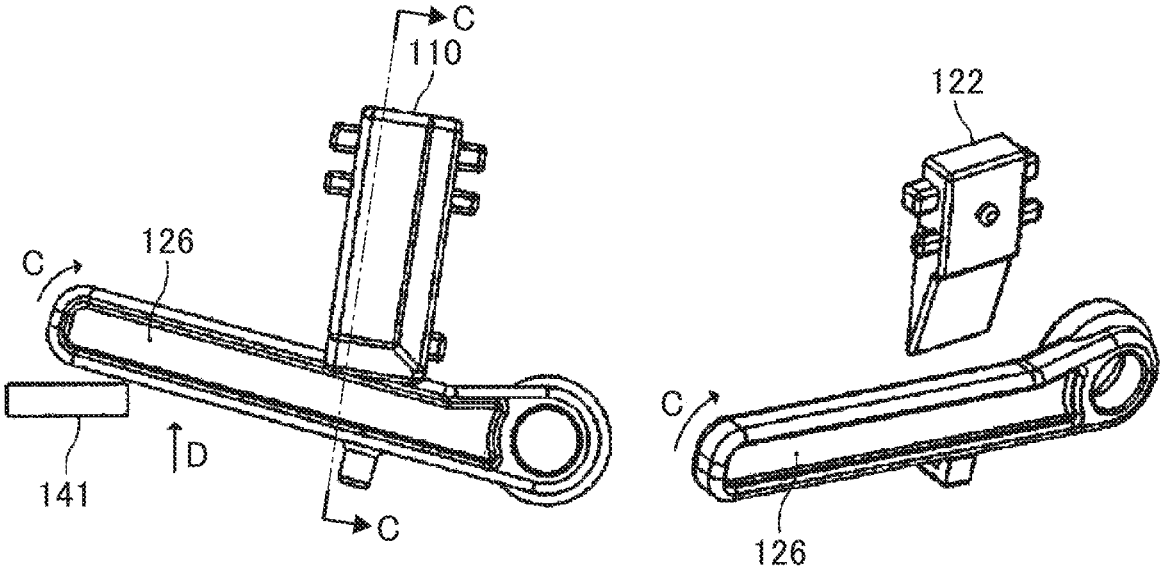
FIGS. 20A and 20B are diagrams illustrating the pressing force adjustment mechanism mounted on the pair of side fences, in steps of an adjusting operation performed by the pressing force adjustment mechanism.
Figure 20B:
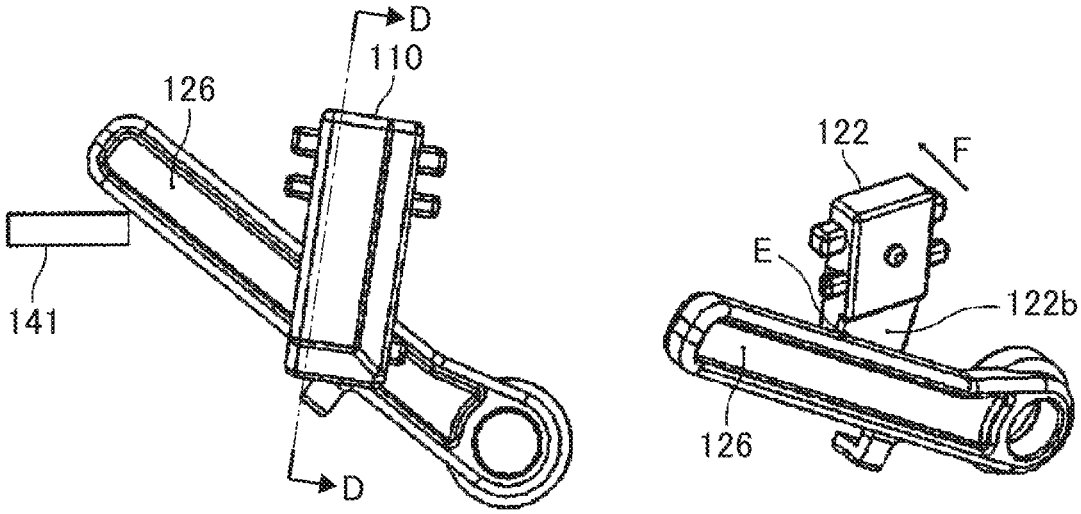
Figure 21A:
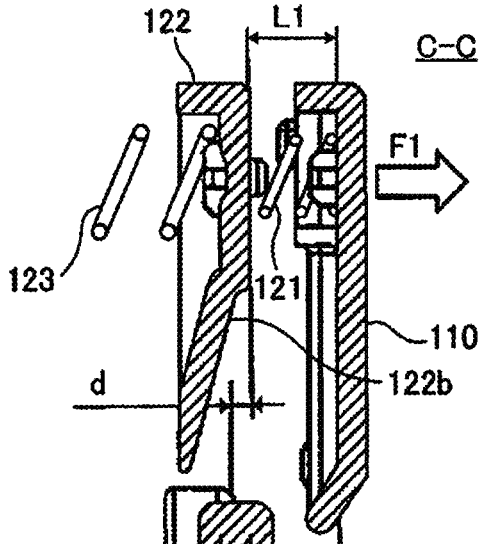
FIG. 21 including FIGS. 21(*a*) and 21(*b*) is a cross-sectional view illustrating the pressing force adjustment mechanism, where FIG. 21(*a*) illustrates the pressing force adjustment mechanism, along a line C-C of FIG. 20A and FIG. 21(*b*) illustrates the pressing force adjustment mechanism, along a line D-D of FIG. 20B.
Figure 21B:
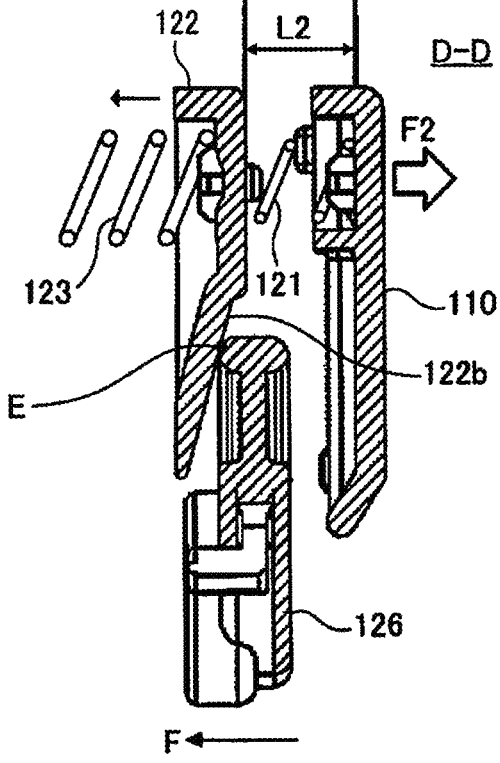

FIGS. 20A and 20B are diagrams illustrating the pressing force adjustment mechanism 120A mounted on the pair of bypass side fences 140, in steps of an adjusting operation performed by the pressing force adjustment mechanism 120A provided on the bypass side fence 140. To be more specific, FIG. 20A is a diagram illustrating a state in which the bottom plate 141 of the bypass sheet feed tray is brought into contact with the rotary lever 126, and FIG. 20B is a diagram illustrating a state in which the rotary lever 126 is brought into contact with the adjustment member 122. FIG. 21 including FIGS. 21(*a*) and 21(*b*) is a cross-sectional view illustrating the pressing force adjustment mechanism 120A, where FIG. 21(*a*) illustrates the pressing force adjustment mechanism 120A, along a line C-C of FIG. 20A and FIG. 21(*b*) illustrates the pressing force adjustment mechanism 120A, along a line D-D of FIG. 20B.

The adjusting operation of the pressing force of the pressing force adjustment mechanism 120A provided on the bypass side fence 140 is similar to the adjusting operation of the pressing force adjustment mechanism 120 provided on the side fence 102 of the sheet feed tray 5. That is, the bottom plate 141 of the bypass sheet feed tray is lifted to contact the other end of the rotary lever 126. Then, the other end of the rotary lever 126 is lifted by the bottom plate 141 of the bypass sheet feed tray, and the rotary lever 126 is rotated in the counterclockwise direction indicated by arrow C in FIG. 20A.

At this time, the rotary lever 126 is not in contact with the lever contact portion 122*b* of the adjustment member 122, and the length of the first pressure spring 121 is L1 [mm], as illustrated in FIG. 21(*a*).

When the thickness of the sheet bundle loaded on the bottom plate 141 of the bypass sheet feed tray reaches a predetermined thickness, the rotary lever 126 contacts the lever contact portion 122*b* of the adjustment member 122. From this state, the bottom plate 141 is lifted as the number of sheets of the sheet bundle decreases. When the rotary lever 126 rotates in the direction C in FIG. 20A, the rotary lever 126 pushes in the lever contact portion 122*b*. As a result, the adjustment member 122 moves to the side opposite to the sheet side, as indicated by arrow F in FIG. 20B, against the biasing force of the second pressure spring 123 and the position in the width direction (i.e., the Y direction) of the adjustment member 122 is changed.

As a result, the length of the first pressure spring 121 extends from L1 [mm] to L2 [mm] as illustrated in FIG. 21(*b*), and the compression amount of the first pressure spring 121 decreases by d [mm]. As a result, the pressing force by the pressing member 110 to press the sheet bundle is reduced. In this manner, as the number of sheets of the sheet bundle Pt loaded on the bypass sheet feed tray decreases, the adjustment member 122 is displaced to the side opposite to the sheet side, and the compression amount of the first pressure spring 121 gradually decreases, so that the pressing force of the sheet (of the sheet bundle Pt) by the pressing member 110 is gradually reduced. Therefore, the pressing force of the sheet (of the sheet bundle Pt) by the pressing member 110 is reduced in accordance with a decrease in stiffness of the sheet bundle Pt in association with the decrease in the number of sheets of the sheet bundle Pt, and the sheet bundle Pt is prevented from being buckled due to the pressing force of the pressing member 110. Accordingly, the sheet is prevented from being fed in a bent state, and occurrence of wrinkles of the sheet and disturbance of the image position in the width direction are prevented.

It is to be noted that the pressing force adjustment mechanism 120A illustrated in FIGS. 17 to 21 may be applied to the sheet feed tray 5 of the image forming apparatus 100 and the sheet feed tray of the ADF.

Figure 22A:
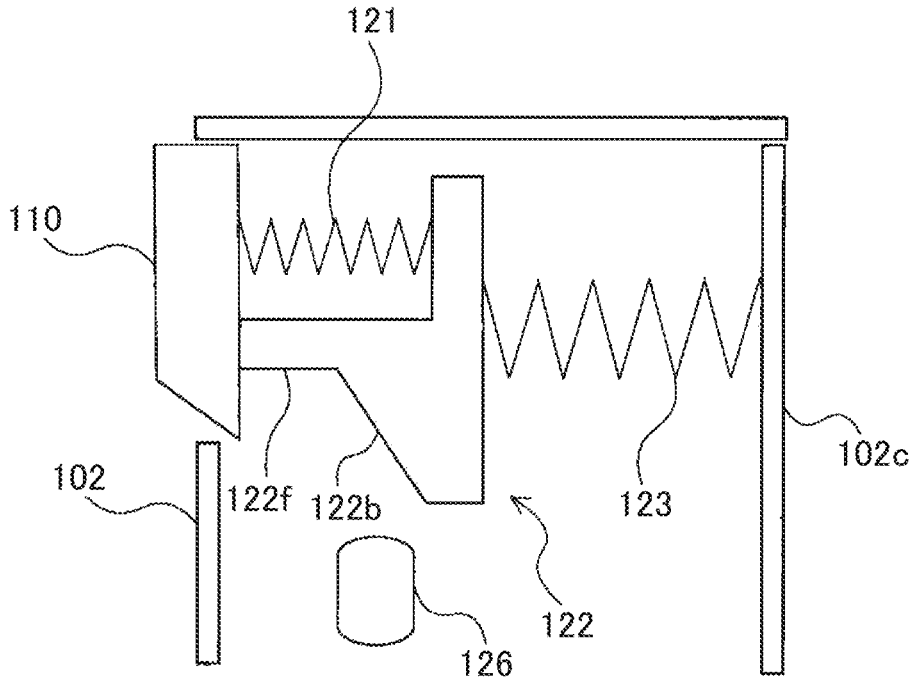
FIGS. 22A and 22B are diagrams illustrating a schematic configuration of the pressing force adjustment mechanism of a variation of the embodiments of this disclosure.
Figure 22B:
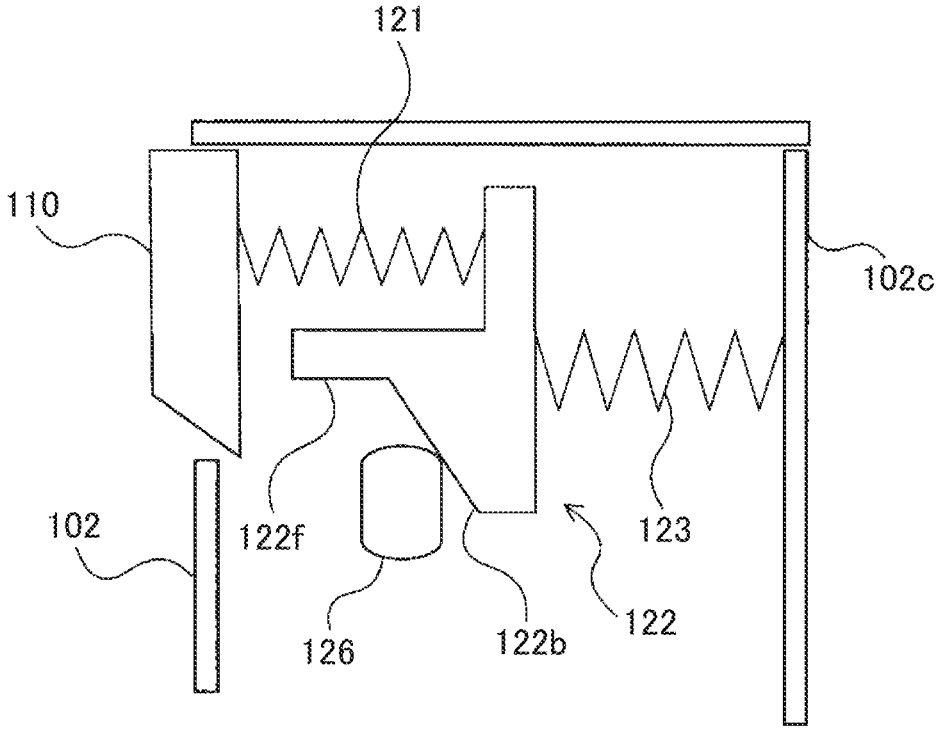
Figure 23:
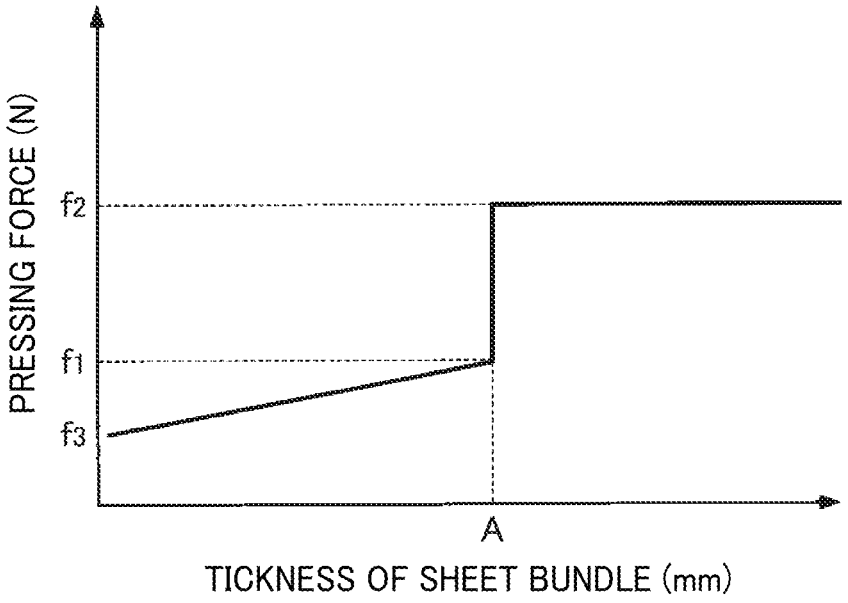
FIG. 23 is a graph illustrating a relation of the pressing force of the pressing member and a thickness of a sheet bundle (the number of sheets) loaded on the movable bottom plate in the variation.

FIGS. 22A and 22B are diagrams illustrating a schematic configuration of the pressing force adjustment mechanism 120A of a variation of the present embodiment of this disclosure. FIG. 23 is a graph illustrating a relation of the pressing force of the pressing member 110 and a thickness of the sheet bundle (i.e., the number of sheets) loaded on the movable bottom plate 106 in this variation.

The variation of the pressing force adjustment mechanism 120A illustrated in FIGS. 22A and 22B has both the configuration of the first example and the configuration of the second example. Similar to the first example, the first pressure spring 121 is held by the adjustment member 122 and the pressing member 110 in this variation. Similar to the second example, the adjustment member 122 includes the contact protrusion 122*f*. The contact protrusion 122*f* contacts the pressing member 110 in a state in which the rotary lever 126 is not in contact with the adjustment member 122. The biasing force f2 of the second pressure spring 123 is greater than the biasing force f1 of the first pressure spring 121.

As illustrated in FIG. 22A, in a state in which the contact protrusion 122*f* contacts the pressing member 110, the biasing force of the first pressure spring 121 is an inner stress of a member including the pressing member 110 and the adjustment member 122. At this time, the biasing force applied to the pressing member 110 is the biasing force f2 of the second pressure spring 123 alone (see FIG. 23).

As illustrated in FIG. 22B, when the adjustment member 122 moves to the side opposite to the sheet side by the rotary lever 126, and the contact protrusion 122*f* of the adjustment member 122 separates from the pressing member 110, the biasing force applied to the pressing member 110 is switched from the biasing force 12 of the second pressure spring 123 to the biasing force f1 of the first pressure spring 121. Accordingly, as illustrated in FIG. 23, the pressure by the pressing member 110 is switched in a rectangular manner as in the second example.

Thereafter, as in the first example, as the number of sheets of the sheet bundle Pt decreases, the adjustment member 122 is displaced to the side opposite to the sheet side, and the compression amount of the first pressure spring 121 gradually decreases. Consequently, the pressing force to the sheet (of the sheet bundle Pt) by the pressing member 110 is gradually reduced (see FIG. 23). In this variation, the configuration of the pressing force adjustment mechanism 120A obtains the advantages of the first example and the second example.

The configurations according to the above-descried embodiments are not limited thereto. This disclosure can achieve the following aspects effectively.

Aspect 1.

In Aspect 1, a sheet container (for example, the sheet feed tray 5) includes a sheet loader (for example, the movable bottom plate 106), a pair of sheet regulators (for example, the near side fence 101 and the far side fence 102), a pressing member (for example, the pressing member 110), and a pressing force adjusting device (for example, the pressing force adjustment mechanism 120 and the pressing force adjustment mechanism 120A). The sheet loader is movable in a vertical direction and configured to load a sheet (for example, the sheet P). The pair of sheet regulators is configured to regulate a position in a width direction of the sheet loaded on the sheet loader. The pressing member is disposed on at least one of the pair of sheet regulators and configured to press a lateral end face of the sheet, toward another one of the pair of sheet regulators in the width direction of the sheet. The pressing force adjusting device is configured to adjust pressing force generated by the pressing member to the sheet while maintaining a state in which the pressing member applies the pressing force to the sheet.

With this configuration, when the number of sheets loaded on the sheet loader becomes small and stiffness of the sheet bundle becomes low, the pressing force adjusting device reduces the pressing force applied to the sheet by the pressing member. As a result, the pressing force of the pressure member is made weaker than the stiffness of the sheet bundle, and the buckling of the sheet is prevented when the sheets remaining on the sheet loader decreases. Even when the number of remaining sheets decreases, the pressing force is not released, and the pressing member presses the sheet to regulate the position of the sheet in the width direction by the pressing member and said another one of the pair of sheet regulators. Therefore, the position of the sheet in the width direction of the sheet is regulated to the lowermost sheet of a sheet bundle, and the position of the sheet in the width direction at the time of sheet feeding is aligned to the lowermost sheet of the sheet bundle.

Aspect 2.

In Aspect 1, the pressing force adjusting device includes a plurality of biasing members (for example, the first pressure spring 121 and the second pressure spring 123), and an adjuster (for example, the adjustment member 122). The plurality of biasing members is configured to bias to the pressing member (for example, the pressing member 110) in the width direction toward the sheet (for example, the sheet P). The adjuster is configured to change a number of the plurality of biasing members biasing the pressing member, to adjust a biasing force of the plurality of biasing members.

With this configuration, as described in the first example, by changing the number of biasing members to bias the pressing member by the adjustment member (in the present embodiment, from two to one: see FIGS. 12A and 12B), the biasing force of the biasing member applied to the pressing member is changed in a rectangular manner, and the pressing force applied to the sheet by the pressing member is adjusted.

Therefore, when the number of sheets loaded on the sheet loader (for example, the movable bottom plate 106) becomes small and the stiffness of the sheet bundle becomes low, the number of biasing members that bias the pressing member by the adjustment member 122 is reduced to decrease the pressing force applied to the sheet by the pressing member by the pressing force adjustment mechanism. As a result, the pressing force of the pressing member is made weaker than the stiffness of the sheet bundle, and the buckling of the sheet is prevented when the sheets remaining on the sheet loader decreases. Even when the number of remaining sheets is reduced, the pressing force is not released, and the pressing member presses the sheet to regulate the position of the sheet in the width direction by the pressing member and said another sheet regulator. Therefore, the position of the sheet in the width direction is regulated to the lowermost sheet of the sheet bundle, and the position of the sheet in the width direction at the time of sheet feeding is aligned to the lowermost sheet of the sheet bundle.

Aspect 3.

In Aspect 2, the adjuster (for example, the adjustment member 122) is movable in the width direction of the sheet (for example, the sheet P) in a given range. The pressing force adjusting device (for example, the pressing force adjustment mechanism 120) further includes a position changer (for example, the rotary lever 126) configured to change a position of the adjuster in the width direction. The position changer is configured to move the adjuster to reduce a number of the plurality of biasing members biasing the pressing member, in accordance with a decrease in the number of sheets loaded on the sheet loader (for example, the movable bottom plate 106).

With this configuration, as described above in the first example, the pressing force by the pressing member (for example, the pressing member 110) to the sheet (of the sheet bundle) is decreased according to the decrease in stiffness of the sheet bundle according to the decrease in the number of sheets loaded on the sheet loader As a result, the sheet is prevented from buckling due to the pressing force of the pressing member when the number of the sheets loaded on the sheet loader is reduced.

Aspect 4.

In Aspect 3, one of the plurality of biasing members (for example, the second pressure spring 123) is configured to bias the adjuster (for example, the adjustment member 122) toward the sheet (for example, the sheet P) in the width direction to bring the adjuster into contact with the pressing member (for example, the pressing member 110). The position changer (for example, the rotary lever 126) is configured to move the adjuster to separate from the pressing member in the width direction in accordance with a decrease in the number of sheets loaded on the sheet loader (for example, the movable bottom plate 106).

With this configuration, as described above in the first example, since the adjustment member is separated from the pressing member, the biasing member (for example, the second pressure spring 123) that biases the pressing member via the adjuster no longer biases the pressing member. As a result, the number of biasing members that bias the pressing member is reduced.

Aspect 5.

In Aspect 4, the position changer (for example, the rotary lever 126) is configured to move the adjuster (for example, the adjustment member 122) to separate from the pressing member (for example, the pressing member 110) in the width direction, along with elevation of the sheet loader (for example, the movable bottom plate 106).

With this configuration, it is possible to decrease the number of biasing members that press the pressing member in accordance with a decrease in the number of sheets loaded on the sheet loader such as the movable bottom plate 106.

Aspect 6.

In Aspect 5, the position changer (for example, the rotary lever 126) includes a lever (for example, the rotary lever 126) configured to rotate along with vertical movement of the sheet loader (for example, the movable bottom plate 106). The lever is configured to rotate by a given angle from a rotation position in a case in which the sheet loader is located at a lowermost position, to contact the adjuster (for example the adjustment member 122) to cause the adjuster to separate from the pressing member in the width direction.

With this configuration, the lever comes into contact with the adjuster to move the adjuster so as to be separated from the pressing member when the stiffness of the sheet bundle becomes lower than the pressing force of the pressing member. As a result, when the thickness of the sheet bundle is sufficient and the stiffness of the sheet bundle is sufficient, the pressure member is biased by a plurality of biasing members and presses the sheet bundle with a predetermined pressing force. As a result, the position of the sheet in the width direction is regulated by the pressing member and said another sheet regulator. When the number of sheets in the sheet bundle reaches the number that causes the buckling, the number of biasing members that bias the pressing member decreases, and the pressing force applied to the sheet by the pressing member decreases, so that the sheet is prevented from buckling.

Aspect 7.

In Aspect 1, the pressing force adjusting device (for example, the pressing force adjustment mechanism 120) includes a biasing member (for example, the first pressure spring 121), an adjuster (for example, the adjustment member 122), and a position changer (for example, the rotary lever 126 and the second pressure spring 123). The biasing member is configured to bias the pressing member (for example, the pressing member 110) in the width direction toward the sheet (for example, the sheet P). The adjuster is movable in the width direction in a given range and configured to adjust a biasing force of the biasing member to the pressing member. The position changer is configured to change a position of the adjuster in the width direction.

With this configuration, as described above in the second example, by changing the position of the adjuster in the sheet width direction by the position changer, the length of the biasing member is changed, and the biasing force applied to the pressing member is changed. In this manner, the biasing force of the biasing member applied to the pressing member is changed, so that the pressing force by the pressing member to the sheet is adjusted.

Since the pressing member adjusts the pressing force applied to the sheet without moving in the sheet width direction, the pressing member comes into contact with the end face of the sheet in the width direction to press the end face of the sheet in the sheet width direction even after the pressing force adjustment. As a result, the pressing force of the pressing member to the sheet is not released and the pressing force is adjusted.

Aspect 8.

In Aspect 7, the position changer (for example, the rotary lever 126) is configured to move the adjuster (for example, the adjustment member 122) to reduce the biasing force of the biasing member (for example, the first pressure spring 121) to the pressing member (for example, the pressing member 110), in accordance with a decrease in the number of sheets loaded on the sheet loader (for example, the movable bottom plate 106).

With this configuration, as described above in the second example, the pressing force by the pressing member to the sheet (of the sheet bundle) is decreased according to the decrease in stiffness of the sheet bundle according to the decrease in the number of sheets loaded on the sheet loader such as the movable bottom plate 106. As a result, the sheet is prevented from buckling due to the pressing force of the pressing member when the number of the sheets loaded on the sheet loader is reduced.

Aspect 9.

In Aspect 8, the position changer (for example, the rotary lever 126) is configured to move the adjuster (for example, the adjustment member 122) to separate from the pressing member (for example, the pressing member 110) in the width direction, along with elevation of the sheet loader (for example, the movable bottom plate 106).

With this configuration, as described above in the present embodiment, the biasing force to the pressing member by the biasing member such as the first pressure spring 121 is decreased according to the decrease in the number of sheets loaded on the sheet loader such as the movable bottom plate 106.

Aspect 10.

In Aspect 9, the position changer (for example, the rotary lever 126) includes a lever (for example, the rotary lever 126) configured to rotate along with vertical movement of the sheet loader (for example, the movable bottom plate 106). The lever is configured to rotate by a given angle from a rotation position in a case in which the sheet loader is located at a lowermost position, to contact the adjuster (for example, the adjustment member 122) to cause the adjuster to separate from the pressing member in the width direction.

With this configuration, as described above in the present embodiment, the lever comes into contact with the adjuster to move the adjuster so as to be separated from the pressing member when the stiffness of the sheet bundle becomes lower than the pressing force of the pressing member (in the present embodiment, when the thickness of the sheet bundle is 4.7 mm). As a result, when the thickness of the sheet bundle is sufficient and the stiffness of the sheet bundle is sufficient, the sheet bundle is pressed with a predetermined pressure and the position of the sheet in the width direction is regulated by the pressing member and said another sheet regulator. When the number of sheets in the sheet bundle reaches the number of sheets to cause the buckling, the pressing force applied to the sheet by the pressing member decreases, so that the sheet is prevented from buckling.

Aspect 11.

In Aspect 10, the position changer (for example, the rotary lever 126) includes another biasing member (for example, the second pressure spring 123) configured to bias the adjuster (for example, the adjustment member 122) in the width direction toward the sheet (for example, the sheet P). The pressing force adjusting device (for example, the pressing force adjustment mechanism 120) includes a regulator (for example, the adjuster contact face 134*a* and the regulator 138) configured to contact the adjuster to regulate movement of the adjuster toward the sheet due to a biasing force of said another biasing member.

With this configuration, as described above in the second example, after the adjuster is moved to the side separating from the pressing member (for example, the pressing member 110) by the position changer such as the rotary lever 126, when the position changer is separated from the adjuster, the adjuster is automatically moved to the sheet side by the biasing force of the second biasing member, and the pressing force of the pressing member is increased. By providing a regulator (for example, the adjuster contact face 134*a*), the biasing force of the second biasing member applied to the adjuster is received by the regulator. As a result, the biasing force of the second biasing member to the adjuster is prevented from acting on the pressing member. Since the movement of the adjuster to the sheet side is regulated by the regulator, the pressing force of the pressing member is prevented from becoming higher than a specified pressure.

Aspect 12.

In Aspect 11, the biasing force of said another biasing member (for example, the second pressure spring 123) is greater than the biasing force of the biasing member (for example, the first pressure spring 121).

With this configuration, as described above in the present embodiment, when the lever (for example, the rotary lever 126) is not in contact with the adjuster (for example, the adjustment member 122), the adjuster is brought into contact with the regulator (for example, the adjuster contact face 134*a*).

Aspect 13.

In Aspect 11 or Aspect 12, the biasing member (for example, the first pressure spring 121) and said another biasing member (for example, the second pressure spring 123) are configured to bias the adjuster (for example, the adjustment member 122) on a substantially same line along the width direction.

With this configuration, as described above in the present embodiment, the rotation moment is restrained from occurring in the adjuster and the twisting of the adjuster is prevented. As a result, the adjuster is smoothly moved in the width direction, and the pressing force is adjusted excellently.

Aspect 14.

In any one of Aspects 11 to 13, the sheet container (for example, the sheet feed tray 5) further includes an adjuster holder (for example, the adjuster holders 134) configured to hold the adjuster (for example, the adjustment member 122). The regulator (for example, the regulator 138) is disposed in a portion different from the adjuster holder.

With this configuration, as described above in the present embodiment, even when the adjuster and the pressing member (for example, the pressing member 110) are held by the same holder, the adjuster contacts the regulator to regulate the movement to the sheet side of the adjuster.

Aspect 15.

In any one of Aspects 2 to 14, the sheet container (for example, the sheet feed tray 5) further includes a pressing member holder (for example, the pressing member holders 133) configured to hold the pressing member (for example, the pressing member 110). The pressing member holder is configured to hold the adjuster (for example, the adjustment member 122) together with the pressing member.

With this configuration, as described above in the present embodiment, space is saved when compared to a case in which the adjuster holder that holds the adjuster and the pressing member holder that holds the pressing member are provided separately. As a result, the pressing force adjustment mechanism is accommodated in the sheet regulator (for example, the side fence) which is low in height.

Aspect 16.

In any one of Aspects 1 to 15, the sheet container (for example, the sheet feed tray 5) further includes a pressing member holder (for example, the pressing member holders 133) and a pressing member lower end regulator (for example, the pressing member lower end regulating face 139). The pressing member holder is configured to hold the pressing member (for example, the pressing member 110). The pressing member lower end regulator configured to contact the pressing member to regulate movement of the pressing member toward the sheet (for example, the sheet P). The pressing member lower end regulator is disposed in a portion different from the pressing member holder.

With this configuration, the pressing member is prevented from rotating about the portion held by the pressing member holder as a fulcrum and the lower end of the pressing member 110 is prevented from protruding from the sheet regulating face of the sheet regulator.

Aspect 17.

In Aspect 1, the pressing force adjusting device (for example, the pressing force adjustment mechanism 120) includes a biasing member (for example, the first pressure spring 121), an adjuster (for example, the adjustment member 122), and a rotary member (for example, the rotary lever 126). The biasing member is configured to bias the pressing member (for example, the pressing member 110) in the width direction toward the sheet (for example, the sheet P). The adjuster is disposed to be rotatable in a sheet conveyance direction and configured to adjust a biasing force of the biasing member to the pressing member. The rotary member is configured to rotate the adjuster.

With this configuration, as described above in the variation, by rotating the adjuster by the rotary member, the length of the biasing member (for example, the first pressure spring 121) is changed and the biasing force applied to the pressing member is changed. As a result, the pressing force applied to the sheet of the pressing member is adjusted.

Aspect 18.

In Aspect 18, a sheet feeding device (for example, the sheet feeding device 200) includes the sheet container (for example, the sheet feed trays 5) of any one of Aspects 1 to 17, and a sheet feeding unit (for example, the sheet feed roller 51, the sheet separation and conveyance roller 52, and the reverse roller 53). The sheet container is configured to contain a sheet (for example, the sheet P). The sheet feeding unit is configured to feed the sheet contained in the sheet container.

With this configuration, as described above in the present embodiment, wrinkling of the sheet material is restrained at the time of sheet feeding, and to the lowermost sheet of the sheet bundle is fed with the position in the width direction aligned.

Aspect 19.

In Aspect 19, an image forming apparatus (for example, the image forming apparatus 100) includes the sheet container (for example, the sheet feed trays 5) of any one of Aspects 1 to 18, and an image forming device (for example, the image forming units 2Y, 2C, 2M, and 2K). The sheet container is configured to contain a sheet (for example, the sheet P). The image forming device is configured to form an image on the sheet fed by the sheet container.

With this configuration, as described above in the present embodiment, disturbance in the position in the width direction of the image on the sheet is prevented.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

What is claimed is:

1. A sheet container comprising:

a sheet loader movable in a vertical direction and configured to load a sheet, a number of sheets being loadable in the sheet loader;

a pair of sheet regulators configured to regulate a position in a width direction of the sheet loaded on the sheet loader;

a pressing member disposed on at least one of the pair of sheet regulators and configured to press a lateral end face of the sheet, toward another one of the pair of sheet regulators in the width direction of the sheet; and a pressing force adjusting device configured to adjust a pressing force generated by the pressing member to the sheet while maintaining a state in which the pressing member applies the pressing force to the sheet, the pressing force adjusting device including a plurality of biasing members configured to bias to the pressing member toward the sheet in the width direction, an adjuster configured to change a number of the plurality of biasing members biasing the pressing member in the plurality of biasing members, to adjust a biasing force of the plurality of biasing members, the adjuster being movable in a range in the width direction of the sheet, and a position changer configured to change a position of the adjuster in the width direction, the position changer being configured to move the adjuster to reduce the number of the plurality of biasing members biasing the pressing member, in accordance with a decrease in the number of sheets loaded on the sheet loader.

2. The sheet container according to claim 1, wherein one of the plurality of biasing members is configured to bias the adjuster toward the sheet in the width direction to bring the adjuster into contact with the pressing member, and wherein the position changer is configured to move the adjuster to separate from the pressing member in the width direction, in accordance with a decrease in the number of sheets loaded on the sheet loader.

3. The sheet container according to claim 2, wherein the position changer is configured to move the adjuster to separate from the pressing member in the width direction, along with elevation of the sheet loader.

4. The sheet container according to claim 3, wherein the position changer includes a lever configured to rotate along with vertical movement of the sheet loader, and wherein the lever is configured to rotate by a given angle from a rotation position in a case in which the sheet loader is located at a lowermost position, to contact the adjuster to cause the adjuster to separate from the pressing member in the width direction.

5. The sheet container according to claim 1, further comprising a pressing member holder configured to hold the pressing member, wherein the pressing member holder is configured to hold the adjuster together with the pressing member.

6. The sheet container according to claim 1, further comprising:

a pressing member holder configured to hold the pressing member; and a pressing member lower end regulator configured to contact the pressing member to regulate movement of the pressing member toward the sheet, wherein the pressing member lower end regulator is disposed in a portion different from the pressing member holder.

7. The sheet container according to claim 1, wherein the adjuster is disposed to be rotatable in a sheet conveyance direction; and wherein the pressing force adjusting device includes:

a rotary member configured to rotate the adjuster.

8. A sheet feeding device comprising:

the sheet container according to claim 1, configured to contain a sheet; and a sheet feeding unit configured to feed the sheet contained in the sheet container.

9. An image forming apparatus comprising:

the sheet container according to claim 1, configured to contain a sheet; and an image forming device configured to form an image on the sheet fed by the sheet container.

10. A sheet container, comprising:

a sheet loader movable in a vertical direction and configured to load a sheet, a number of sheets being loadable in the sheet loader;

a pair of sheet regulators configured to regulate a position in a width direction of the sheet loaded on the sheet loader;

a pressing member disposed on at least one of the pair of sheet regulators and configured to press a latera end face of the sheet, toward another one of the pair of sheet regulators in the width direction of the sheet; and a pressing force adjusting device configured to adjust a pressing force generated by the pressing member to the sheet while maintaining a state in which the pressing member applies the pressing force to the sheet, the pressing force adjusting device including a biasing member configured to bias the pressing member in the width direction toward the sheet;

an adjuster movable in a range in the width direction and configured to adjust a biasing force of the biasing member to the pressing member; and a position changer configured to change a position of the adjuster in the width direction, wherein the position changer is configured to move the adjuster to reduce the biasing force of the biasing member to the pressing member, in accordance with a decrease in the number of sheets loaded on the sheet loader, and wherein the position changer is configured to move the adjuster to separate from the pressing member in the width direction, along with elevation of the sheet loader.

11. The sheet container according to claim 10, wherein the position changer includes a lever configured to rotate along with vertical movement of the sheet loader, and wherein the lever is configured to rotate by a given angle from a rotation position in a case in which the sheet loader is located at a lowermost position, to contact the adjuster to cause the adjuster to separate from the pressing member in the width direction.

12. The sheet container according to claim 11, wherein the position changer includes another biasing member configured to bias the adjuster in the width direction toward the sheet, and wherein the pressing force adjusting device includes a regulator configured to contact the adjuster to regulate movement of the adjuster toward the sheet due to a biasing force of said another biasing member.

13. The sheet container according to claim 12, wherein the biasing force of said another biasing member is greater than the biasing force of the biasing member.

14. The sheet container according to claim 12, wherein the biasing member and said another biasing member are configured to bias the adjuster on a substantially same line along the width direction.

15. The sheet container according to claim 12, further comprising an adjuster holder configured to hold the adjuster, wherein the regulator is disposed in a portion different from the adjuster holder.

16. A sheet feeding device comprising:

the sheet container according to claim 10, configured to contain a sheet; and a sheet feeding unit configured to feed the sheet contained in the sheet container.

17. An image forming apparatus comprising:

the sheet container according to claim 10, configured to contain a sheet; and an image forming device configured to form an image on the sheet fed by the sheet container.

* * * * *